US006014962A

United States Patent [19]

Sato et al.

[11] Patent Number: 6,014,962

[45] Date of Patent: Jan. 18, 2000

[54] ENGINE AIR-FUEL RATIO CONTROLLER

[75] Inventors: Ritsuo Sato; Kimiyoshi Nishizawa, both of Yokohama, Japan

[73] Assignee: Nissan Motor Co., Ltd., Kanagawa, Japan

[21] Appl. No.: 09/058,301

[22] Filed: Apr. 10, 1998

[30] Foreign Application Priority Data

Apr. 11, 1997 [JP] Japan ..... 9-093959

[51] Int. Cl.[7] ..... F02D 41/14

[52] U.S. Cl. ..... 123/674; 123/681; 701/109

[58] Field of Search ..... 123/672, 674, 123/675, 681, 687; 701/109

[56] References Cited

U.S. PATENT DOCUMENTS

| | | | |
|---|---|---|---|
| 4,452,211 | 6/1984 | Wataya | 123/492 |
| 4,571,683 | 2/1986 | Kobayashi et al. | 364/431.05 |
| 4,748,956 | 6/1988 | Iwaki | 123/489 |
| 4,753,208 | 6/1988 | Yamoto et al. | 123/489 |
| 4,870,938 | 10/1989 | Nakaniwa | 123/489 |
| 4,877,006 | 10/1989 | Noguchi et al. | 123/589 |
| 4,911,129 | 3/1990 | Tomisawa | 123/489 |
| 5,255,662 | 10/1993 | Nakajima | 123/674 |
| 5,615,660 | 4/1997 | Iwano et al. | 123/680 |
| 5,669,368 | 9/1997 | Maki et al. | 123/681 |
| 5,704,339 | 1/1998 | Choe et al. | 123/674 |

*Primary Examiner*—Tony M. Argenbright
*Assistant Examiner*—Arnold Castro
*Attorney, Agent, or Firm*—McDermott, Will & Emery

[57] ABSTRACT

Feedback correction of an air-fuel ratio is performed, a feedback correction amount is learned, and applied as a learning value on the next occasion that control is performed. It is determined whether or not an engine is in a high load state, and when the high load state continues for a predetermined time, the feedback correction amount is fixed at a predetermined value. The learning value is fixed at its value based on the feedback correction amount before fixing. The predetermined time is set such that the learning value in the high load state converges within this time. By applying open loop control using this learning value, surging of the vehicle due to the air-fuel ratio feedback control in the high engine load state is prevented, while the air-fuel ratio in this state is controlled precisely to the stoichiometric air-fuel ratio.

19 Claims, 23 Drawing Sheets

ENGINE AIR-FUEL RATIO CONTROLLER

FIELD OF THE INVENTION

This invention relates to air-fuel ratio control of an engine.

BACKGROUND OF THE INVENTION

In a vehicle engine, a change in torque may occur for example due to a pulsation in the intake air supply. In the high load region of the engine, the resistance of the throttle on intake air is small. The torque change due to this intake pulsation therefore becomes larger, and "surging", wherein the vehicle vibrates at low frequencies, tends to occur.

This surging is assisted by feedback control of the engine air-feel ratio. This is because feedback control of the air-fuel ratio causes the air-fuel ratio to oscillate with a predetermined period around a target value.

However if feedback control of the air-fuel ratio is not performed in the high load region of an engine, deviations of the air-fuel ratio, which occur due to production errors and time-dependent deterioration of the fuel injection mechanism such as a fuel injection valve and an air flow meter, are not corrected.

A three-way catalyst which purifies exhaust from the engine performs optimally in the vicinity of the stoichiometric air-fuel ratio. If the air-fuel ratio shifts to rich from the stoichiometric air-fuel ratio, the ability of the three-way catalyst to oxidize hydrocarbons (HC) and carbon monoxide (CO) in the exhaust falls. If the air-fuel ratio shifts to lean from the stoichiometric air-fuel ratio, the ability of the three-way catalyst to reduce nitrogen oxides (NOx) in the exhaust falls. In both cases, harmful components of the exhaust increase.

A possible method of achieving the dual objectives of preventing surging in the high load region of the engine and preventing deviation of the air-fuel ratio, is to introduce learning control instead of feedback control of the air-fuel ratio. Air-fuel ratio feedback control is performed in an engine running region except the high load region, and using an air-fuel ratio correction coefficient learned in this case, air-fuel ratio in the high load region is controlled by an open loop.

The air-fuel ratio correction coefficient in regions other than the high load region is not always effective for correcting a deviation of the air-fuel ratio in the high load region however. In particular, when the flowrate characteristics of the fuel injection valve and air flow meter vary largely in the high load region and other regions, the deviation cannot be covered by a single air-fuel ratio correction coefficient.

SUMMARY OF THE INVENTION

It is therefore an object of this invention to learn an air-fuel ratio correction value which is effective for is the high load region of the engine while avoiding surging.

It is another object of this invention to correct deviation of the air-fuel ratio while preventing surging in the high load region of an engine by using the learned value thus acquired.

In order to achieve the above objects, this invention provides an air-fuel ratio controller for controlling an air-fuel ratio of an air-fuel mixture supplied to an engine. The controller comprises a fuel injection valve for injecting fuel into the engine, a sensor for detecting an engine running condition, an oxygen sensor for detecting an oxygen concentration in the exhaust of the engine, and a microprocessor.

The microprocessor is programmed to calculate a basic injection amount based on the running condition, calculate an air-fuel ratio feedback correction amount based on the oxygen concentration in the exhaust of the engine so that the air-fuel ratio is equal to a stoichiometric air-fuel ratio, store a learning value based on the calculated air-fuel ratio feedback correction amount, correct the basic fuel injection amount by the stored learning amount and the calculated air-fuel ratio feedback correction coefficient so as to calculate a fuel injection amount, and control the fuel injection valve so that the calculated fuel injection amount is injected.

The microprocessor is further programmed to determine from the running condition whether or not the engine is in a predetermined high load region, determine whether or not a high load state where the engine is in the high load region has continued for a predetermined time, fix the air-fuel ratio correction amount to a predetermined value when the high load state has continued for the predetermined time, and perform an open loop control of the air-fuel ratio by applying the learning value.

It is preferable that the microprocessor is further programmed to determine from the running condition whether or not an engine rotation speed has risen to a predetermined high speed region, release the fixing of the air-fuel ratio feedback correction amount when the engine rotation speed has risen to the predetermined high speed region after the high load state has continued for the predetermined time.

It is also preferable that the microprocessor is further programmed to correct the basic fuel injection amount by a stored learning value and a calculated air-fuel ratio feedback correction amount, both of which are obtained outside the high load region, so as to calculate the fuel injection amount outside the high load region, and correct the basic fuel injection amount by a stored learning value and a calculated air-fuel ratio feedback correction amount, both of which are obtained inside the high load region, so as to calculate the fuel injection amount inside the high load region.

It is further preferable that the microprocessor is further programmed to calculate the air-fuel ratio feedback correction amount using a proportional amount and an integral amount, and set the proportional amount used for calculation of the air-fuel ratio feedback correction amount inside the high load region to be smaller than the proportional amount used for calculation of the air-fuel ratio feedback correction amount outside the high load region.

Alternatively, the microprocessor is programmed to calculate the air-fuel ratio feedback correction amount using a proportional amount and an integral amount, and set the integral amount used for calculating the air-fuel ratio feedback correction amount inside the high load region to be smaller than the integral amount used for calculating the air-fuel ratio feedback correction amount outside the high load region.

It is also preferable that the microprocessor is further programmed to calculate the air-fuel ratio feedback correction amount using a proportional amount and an integral amount, and set the proportional amount used for calculating the air-fuel ratio feedback correction amount inside the high load region and the predetermined rotation speed region, to be equal to the proportional amount used for calculating the air-fuel ratio feedback correction amount outside the high load region.

It is also preferable that the microprocessor is further programmed to calculate the air-fuel ratio feedback correction amount using a proportional amount and an integral amount, and set the integral amount used for calculating the air-fuel ratio feedback correction amount inside the high load region and the predetermined rotation speed region, to be equal to the integral amount used for calculating the air-fuel ratio feedback correction amount outside the high load region.

It is also preferable that the predetermined time is set according to a time required until the learning value converges.

It is also preferable that the microprocessor is programmed to calculate a basic fuel injection amount based on the running condition, calculate an air-fuel ratio feedback correction amount using a proportional amount and an integral amount which are calculated based on the oxygen concentration in the exhaust of the engine so that the air-fuel ratio is equal to a stoichiometric air-fuel ratio, store a learning value based on the calculated air-fuel ratio feedback correction amount, correct the basic fuel injection amount by the stored learning amount and the calculated air-fuel ratio feedback correction coefficient so as to calculate a fuel injection amount, control the fuel injection valve so that the calculated fuel injection amount is injected, determine from the running condition whether or not the engine is in a predetermined high load region, determine whether or not a high load state where the engine is in the high load region has continued for a predetermined time, and set the proportional amount and the integral amount to be smaller when the high engine load state continues for the predetermined time.

It is preferable that the microprocessor is further programmed to correct the basic fuel injection amount by a stored learning value and a calculated air-fuel ratio feedback correction amount, both of which are obtained outside the high load region, so as to calculate the fuel injection amount outside the high load region, and correct the basic fuel injection amount by a stored learning value and a calculated air-fuel ratio feedback correction amount, both of which are obtained inside the high load region, so as to calculate the fuel injection amount inside the high load region.

It is also preferable that the proportional amount when the time for which the high load state continues is less than the predetermined time, is set to be smaller than the proportional amount used outside the high load region.

The details as well as other features and advantages of this invention are set forth in the remainder of the specification and are shown in the accompanying drawings.

DESCRIPTION OF THE PREFERRED EMBODIMENTS

Figure 1:
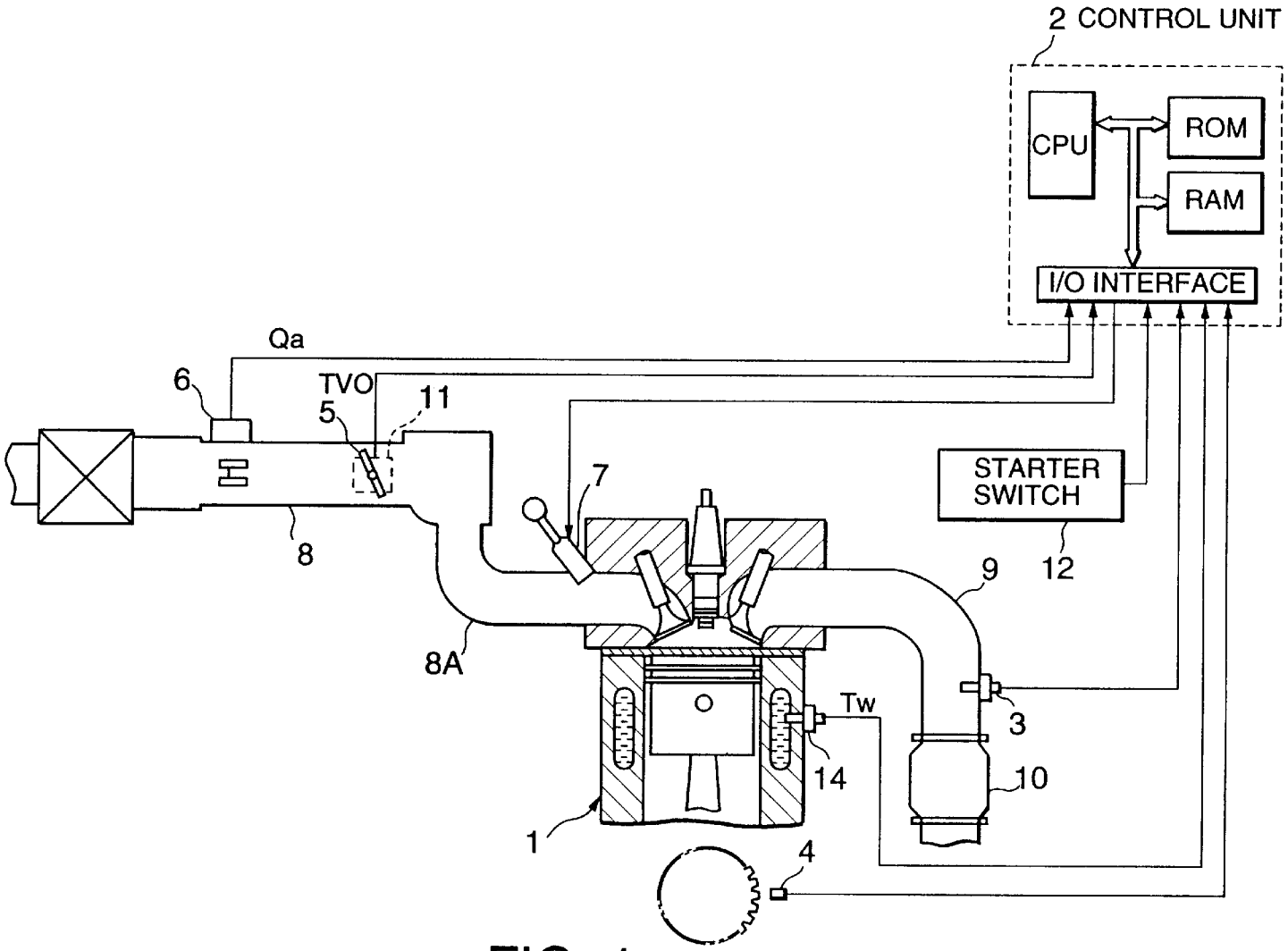
FIG. 1 is a schematic diagram of an air-fuel ratio controller according to this invention.

Referring to FIG. 1 of the drawings, a throttle 5 is provided in an intake passage 8 of a multi-cylinder 4-stroke cycle engine 1 of a vehicle. The intake passage 8 comprises an intake manifold 8A which diverges separately to each cylinder downstream of the throttle 5, and it is connected to each cylinder. A fuel injection valve 7 is provided in the intake manifold 8A. The fuel injection valve 7 injects into the intake air in the intake manifold 8A according to an injection signal from the ccntrol unit 2.

Burnt gas from the fuel which is burnt in the engine 1 passes through an exhaust passage 9, and is discharged into the atmosphere via a three-way catalytic converter 10.

The control unit 2 comprises a microcomputer comprising a central processing unit (CPU), random-access memory (RAM), read only memory (ROM) and input-output (I/O) interface.

A reference position signal (Ref signal) from a crank angle sensor 4 for detecting a predetermined rotation angle of the engine 1 and a unit angle signal (Pos signal) are input to the control unit 2. A throttle opening signal TVO from a throttle sensor 11 for detecting an opening of the throttle 5, an intake air amount signal from an air flow meter 6 provided in the intake passage 8, an engine cooling water temperature signal from a water temperature sensor 14, an air-fuel ratio signal from an oxygen sensor (O2 sensor) 3 provided upstream of the three-way catalytic converter 10 in the exhaust passage 9, and an activation signal from a starter switch 12 for activating a starter motor of the engine 1, are also input to the control unit 2.

Based on these input signals, the control unit 2 calculates an injection pulse width Tp. The basic injection pulse width Tp is used as a basic fuel injection amount value as well as a value showing the load on the engine 1.

The three-way catalytic converter 10 simultaneously purifies NOx, HC and CO in the exhaust with maximum conversion efficiency in a state where the air-fuel ratio is maintained within a fixed range centered on the stoichiometric air-fuel ratio. The control unit 2 performs air-fuel ratio feedback control so that the air-fuel ratio of the exhaust gas varies with a constant period within the above-mentioned range based on an output signal from the O2 sensor 3.

When feedback control of the air-fuel ratio is performed in the high load region of the engine, surging easily occurs, and correct air-fuel ratio control cannot be performed even if the air-fuel ratio correction coefficient learned in another region is applied in the case of open loop control as described hereabove.

Therefore according to this invention, air-fuel ratio feedback control is performed for a limited time after the engine has entered the high load region, and the air-fuel ratio correction coefficient is learned in the meantime. Subsequently, open loop control of the air-fuel ratio is performed using the learned air-fuel ratio correction coefficient during this time period.

Figure 2:
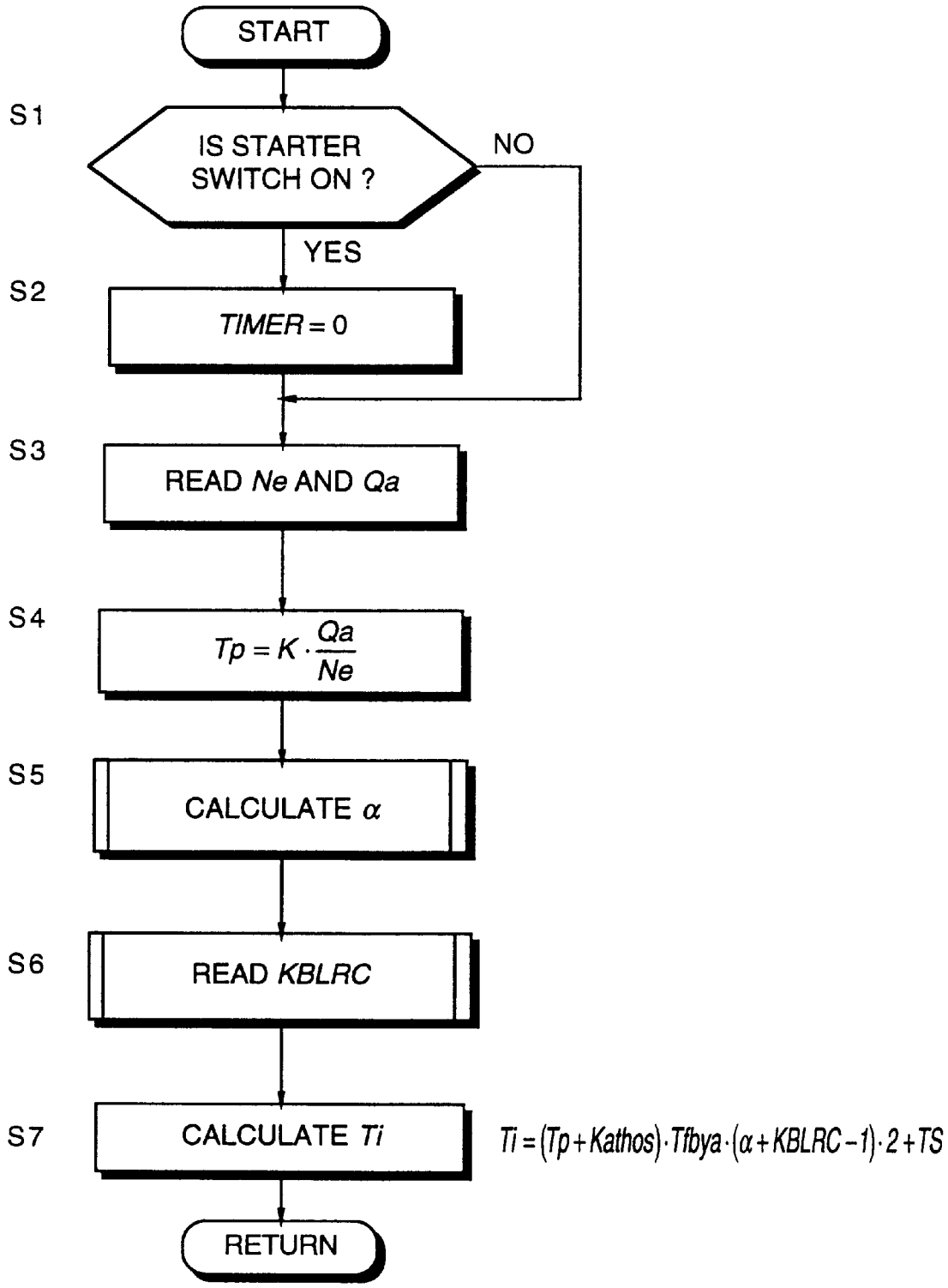
FIG. 2 is a flowchart for describing a fuel injection control process performed by the air-fuel ratio controller.

The details of this control performed by the control unit 2 will now be described referring to flowcharts. The basic fuel injection control process is shown by the flowchart of FIG. 2. This process is executed as a background job or at a fixed interval.

In a step S1, it is determined whether or not a starter motor is operating according to the activation signal input from the starter switch 12. When this signal is ON, i.e. during startup of the engine, the routine proceeds to a step S2, an initial value of 0 is entered in a TIMER value TIMER, and the routine proceeds to a step S3. When the signal is OFF, i.e. after engine startup, the routine jumps from the step S1 to the step S3.

In the step S3, an intake air amount Qa of the engine 1 is calculated from the intake air amount signal input from the air flow meter 6. The engine rotation speed Ne is calculated from the Ref signal from the crank angle sensor 4.

In a step S4, an intake air amount (Qa/Ne) per engine rotation is multiplied by a constant K so as to calculate the basic injection pulse width Tp.

In a step S5, the air-fuel ratio feedback correction coefficient $\alpha$ is read.

Figure 3:
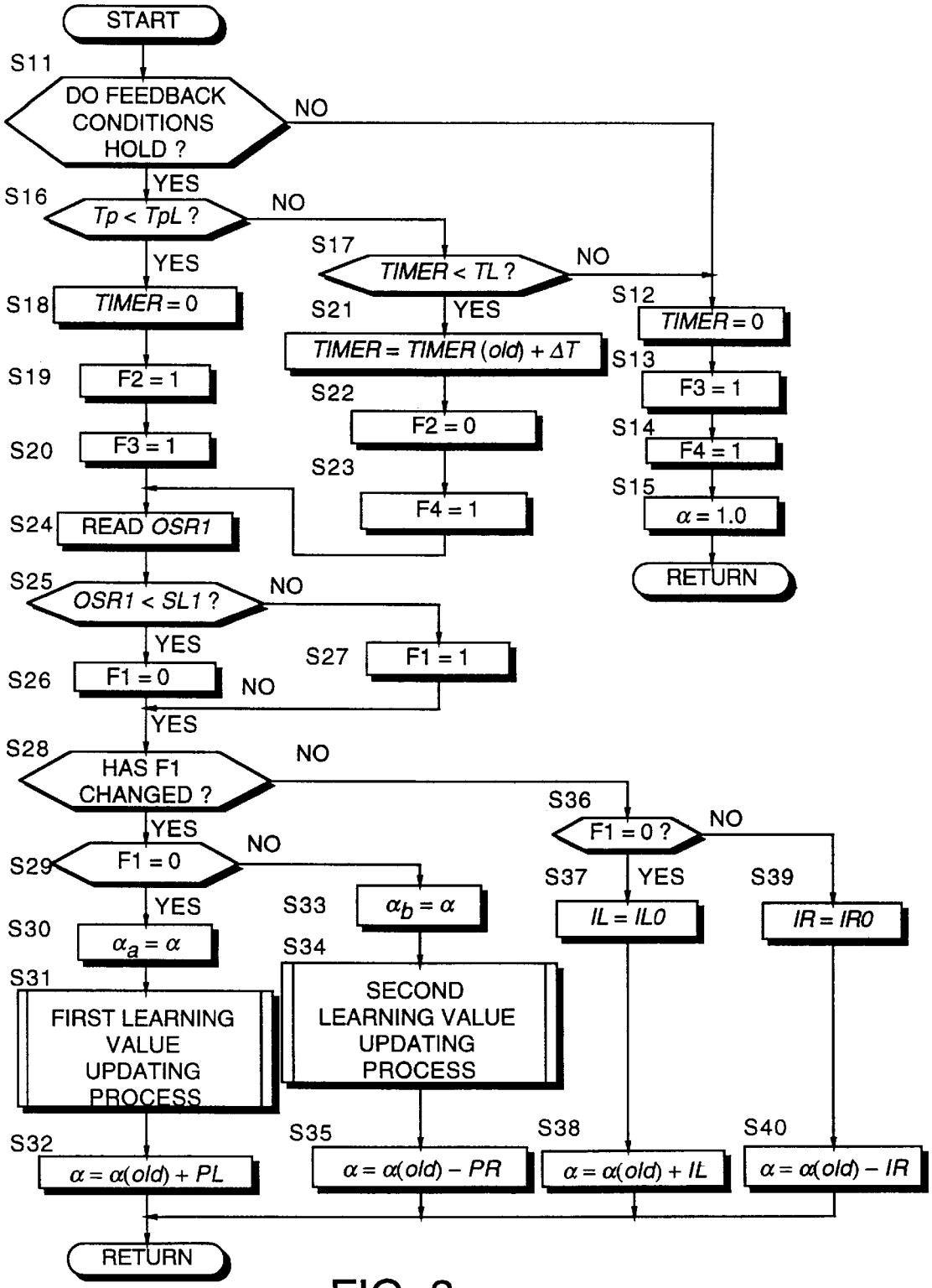
FIG. 3 is a flowchart for describing a process for computing an air-fuel ratio feedback correction coefficient $\alpha$ performed by the air-fuel ratio controller.

The air-fuel ratio feedLback correction coefficient $\alpha$ is calculated by a subroutine shown in FIG. 3.

In a step S6, an air-fuel ratio learning value KBLRC is read. The air-fuel ratio learning value KBLRC is calculated by a process shown in FIGS. 5–7.

In a step S7, a fuel injection pulse width Ti is calculated by the following equation using the air-fuel ratio feedback correction coefficient $\alpha$ and the air-fuel ratio learning value KBLRC.

$$Ti=(Tp+KATHOS)\cdot TFBYA\cdot(\alpha+KBLRC-1)\cdot 2+Ts$$

where,

Kathos=transient correction amount,

Tfbya=target fuel air ratio,

Ts=ineffectual pulse width.

The above equation is a calculation of fuel injection amount for a sequential injection wherein fuel is injected into each cylinder of a multi-cylinder engine This is known for example from U.S. Pat. No. 5,615,660. However, in this document, $\alpha m$ is mentioned instead of KBLRC as the air-fuel ratio learning value.

A pulse signal having a fuel injection pulse width Ti calculated by the above equation is output to the corresponding fuel injection valve 7 once every two engine rotations.

The transient correction amount Kathos in the equation is correction amount for wall flow. The target fuel air ratio Tfbya is a value for increasing the fuel amount, for example whenever the engine 1 is starting cold. When fuel increase is not performed, this value is 1.0. As these fuel increases are not made in the high load region of the engine to which this invention applies, the target fuel air ratio Tfbya is 1.0. An ineffectual pulse width Ts is a value which takes account of a valve opening delay of the fuel injection valve 7.

Next, a subroutine corresponding to the step S5 will be described referring to FIG. 3. This routine is executed at an interval of for example, 10 milliseconds.

Steps S12–S14 and steps S16–S23 in this routine are new steps according to this invention, the remaining parts of the process relating to the calculation of the air-fuel ratio feedback correction coefficient $\alpha$ being known from U.S. Pat. No. 5,255,662.

First, in a step S11, it is determined whether or not air-fuel ratio feedback control conditions hold.

When the engine starts up, when the water temperature is low, during idle running of the engine, when there is an abnormality in the O2 sensor 3, or when the inversion period of the O2 sensor 3 between rich and lean is equal to or greater than a predetermined value, air-fuel ratio feedback control is not performed. Under any conditions except these, it is determined that air-fuel ratio feedback control conditions hold. It should be noted that, in the step S11, the high load region of the engine is not included in the conditions for stopping air-fuel ratio feedback control. This is because air-fuel ratio feedback control is performed for a predetermined short period after the engine enters the high load region as described hereafter.

When air-fuel ratio feedback control conditions do not hold, i.e. when any of the aforementioned conditions exist, the processing of steps S12–S15 is performed.

In the step S12, 0 is entered in the TIMER value TIMER, in the step S13, 1 is set in a flag F3, and in the step S14, 1 is set in a flag F4.

These flags are all initialized to 1 on engine startup.

In the step S15, 1.0 is entered in the air-fuel ratio feedback correction coefficient $\alpha$, and the process is terminated with $\alpha$ clamped.

When air-fuel ratio feedback control conditions hold, the routine proceeds from the step S11 to a step S16.

In the step S16, the predetermined value TpL is compared with the basic injection pulse width Tp. The predetermined value TpL is a value corresponding to a lower limit of the high load region of the engine, and when converted into an intake negative pressure, it corresponds to from −50 mmHg to −100 mmHg.

Figure 4:
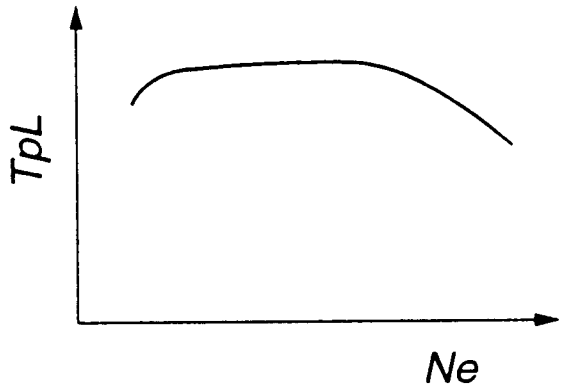
FIG. 4 is a diagram showing the contents of a table of a predetermined value TpL stored by the air-fuel ratio controller.

When $Tp \geqq TpL$, it is determined that the engine is running in the high load region, and when $Tp<TpL$, it is determined that the engine is running in the low load region. TpL is found from the engine rotation speed Ne by looking up a table of contents shown in FIG. 4. This table is stored beforehand in the control unit 2.

In a step S17, the TIMER value TIMER is compared with a predetermined value TL.

The TIMER value TIMER shows an elapsed time after the engine running conditions have entered the high load region. The predetermined value TL may be set for example to 2–3 seconds. The predetermined time TL specifies a continuation time of air-fuel ratio feedback control in the high load region.

As a result of these determinations, when Tp<TpL, i.e. in the low load region, the processing of steps S18–S20 is performed. When Tp≧TpL and TIMER<TL, i.e. until the predetermined time TL elapses after entering the high load region, the processing of steps S21–S23 is performed. After the predetermined time TL has elapsed since entering the high load region, i.e. Tp≧TpL and TIMER≧TL, the processing of the aforementioned steps S12–S15 is performed.

Figures 9A, 9B, 9C, 9D, 9E, 9F, 9G:
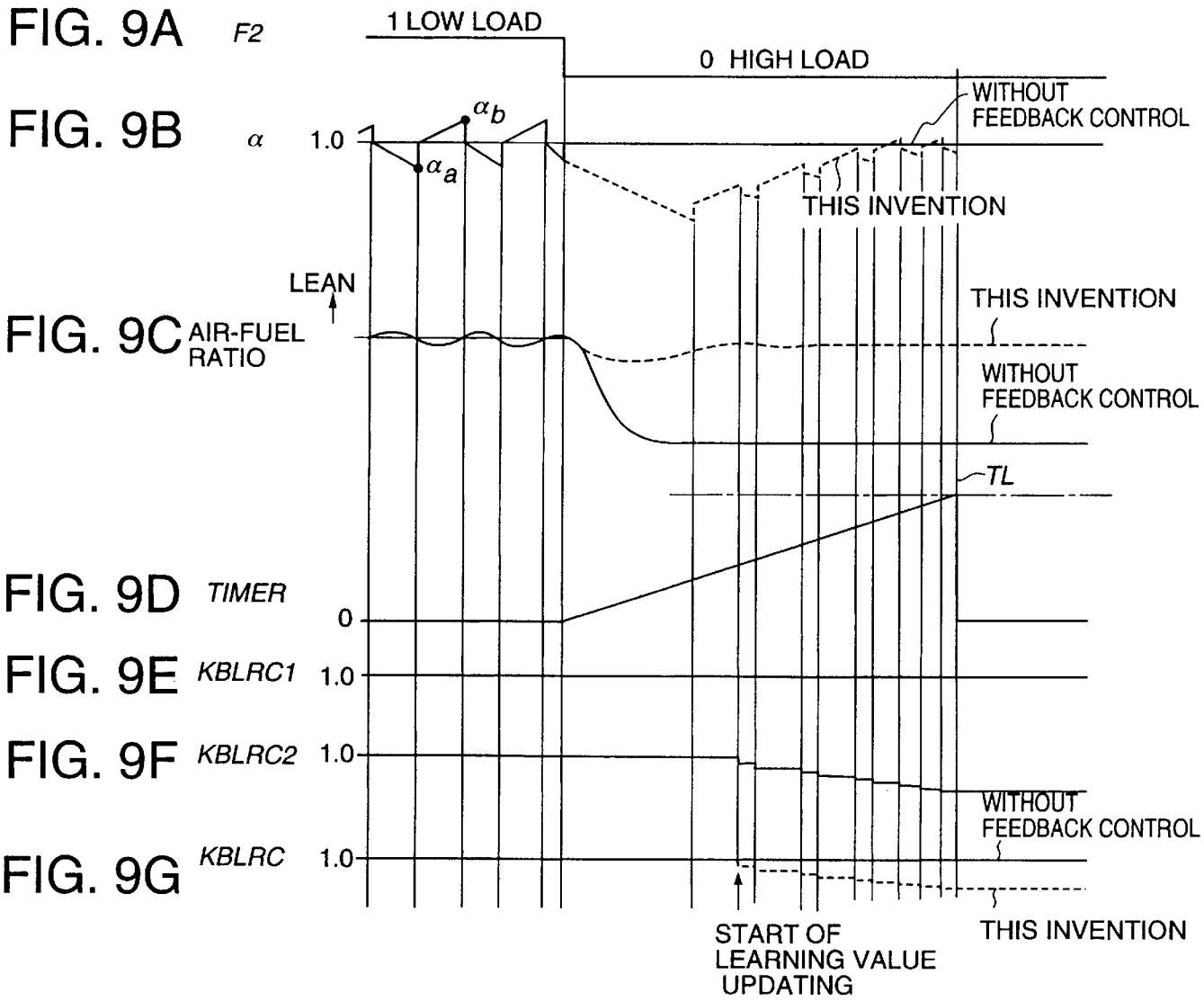
FIGS. 9A–9G are timing charts expressing the control performed by the air-fuel ratio controller.

In the step S18, the TIMER value TIMER is reset to 0, and in the step S21, it is incremented by αT Therefore, the TIMER value TIMER gradually becomes larger as the elapsed time after entering the high load region increases as shown in FIG. 9D.

A flag F2 is a flag showing the load region. It is set to 1 in the step S19, and is reset to 0 in the step S22. As shown in FIG. 9A, F2=1 indicates the low load region, and F2=0 indicates the high load region.

The flags F3, F4 are flags which are necessary when updating learning values as described hereafter. F3 is set to 1 in the step S20, and F4 is set to 1 in the step S23.

In a step S24, a voltage signal OSR1 which obtained by a/D conversion of a signal input from the O2 sensor 3, is read.

In a step S25, the voltage signal OSR1 is compared with a slice level SL1. The slice level SL1 is set to, for example, 500 mV.

When OSR1≧SL1, it is determined that the air-fuel ratio is richer than the stoichiometric air-fuel ratio, and the flag F1 is set to 1 in a step S27.

When OSR1<SL1, it is determined that the air-fuel ratio is leaner than the stoichiometric air-fuel ratio, and the flag F1 is reset to 0 in a step S26.

In other words, the flag F1 is a flag showing the state of the air-fuel ratio.

In a step S28, it is determined whether or not the value of the flag F1 on this occasion is different from its value on the immediately preceding occasion, i.e. whether or not the air-fuel ratio has inverted from rich to lean or from lean to rich.

When the air-fuel ratio has inverted, the routine proceeds to a step S29, and when it has not inverted, the routine proceeds to a step S36.

Although not shown in the flowchart, if the value of the flag F1 is stored in a variable F1(old) at the end of this routine, then on the next occasion the process is executed, it can be determined from F1≠F1(old) that the value of F1 has inverted, and from F1=F1(old) that the value of F1 has not inverted.

(1) When the Air-fuel Ratio has Inverted

In a step S29, it is determined whether or not the flag F1=0. When F1=0, i.e. when the air-fuel ratio is lean, the value of α is transferred to a variable $\alpha_a$ in a step S30.

In a step S31, a first learning value update process is performed by a subroutine described hereafter, and in a step S32, a value obtained by adding a proportional amount PL to an air-fuel ratio feedback correction coefficient α(old) on the immediately preceding occasion, is stored as the air-fuel ratio feedback correction coefficient α, and the process is terminated.

On the other hand when F1=1 in the step S29, i.e. when the air-fuel ratio is rich, the value of α is transferred to a variable $\alpha_b$ in a step S33.

In a step S34, the second learning value update process is performed by the subroutine described hereafter, and in a step S35, a value obtained by deducting a proportional amount PR from the air-fuel ratio feedback correction coefficient α(old) on the immediately preceding occasion, is stored as the air-fuel ratio feedback correction coefficient α, and the process is terminated.

Although not shown in the flowchart, the present air-fuel ratio feedback correction coefficient α can be used as α(old) on the next occasion the process is executed by storing the value of a in the variable α(old) at the end of this routine.

As shown in FIG. 9B, the variable $\alpha_a$ shows the minimum value of α in each variation period of the air-fuel ratio, and the variable $\alpha_b$ shows the maximum value of α in each variation period of the air-fuel ratio.

(2) When the Air-fuel Ratio has not Inverted

When it is determined in the step S28 that the air-fuel ratio has not inverted, the routine proceeds to a step S36.

In the step S36, it is determined whether or not F1=0. When F1=0, i.e. when the air-fuel ratio is lean, an integral amount IL is set equal to a predetermined value IL0 in a step S37. In a step S38, a value obtained by adding the integral amount IL to α(old) which is the air-fuel ratio feedback correction coefficient on the immediately preceding occasion, is stored as the air-fuel ratio feedback correction coefficient α, and the process is terminated.

When on the other hand F1=1 in the step S36, i.e. when the air-fuel ratio is rich, an integral amount IR is set equal to a predetermined value IR0 in a step S39. In a step S4C, a value obtained by deducting an integral amount IR from α(old) which is the air-fuel ratio feedback correction coefficient on the immediately preceding occasion, is stored as the air-fuel ratio feedback correction coefficient α, and the process is terminated.

Figure 5:
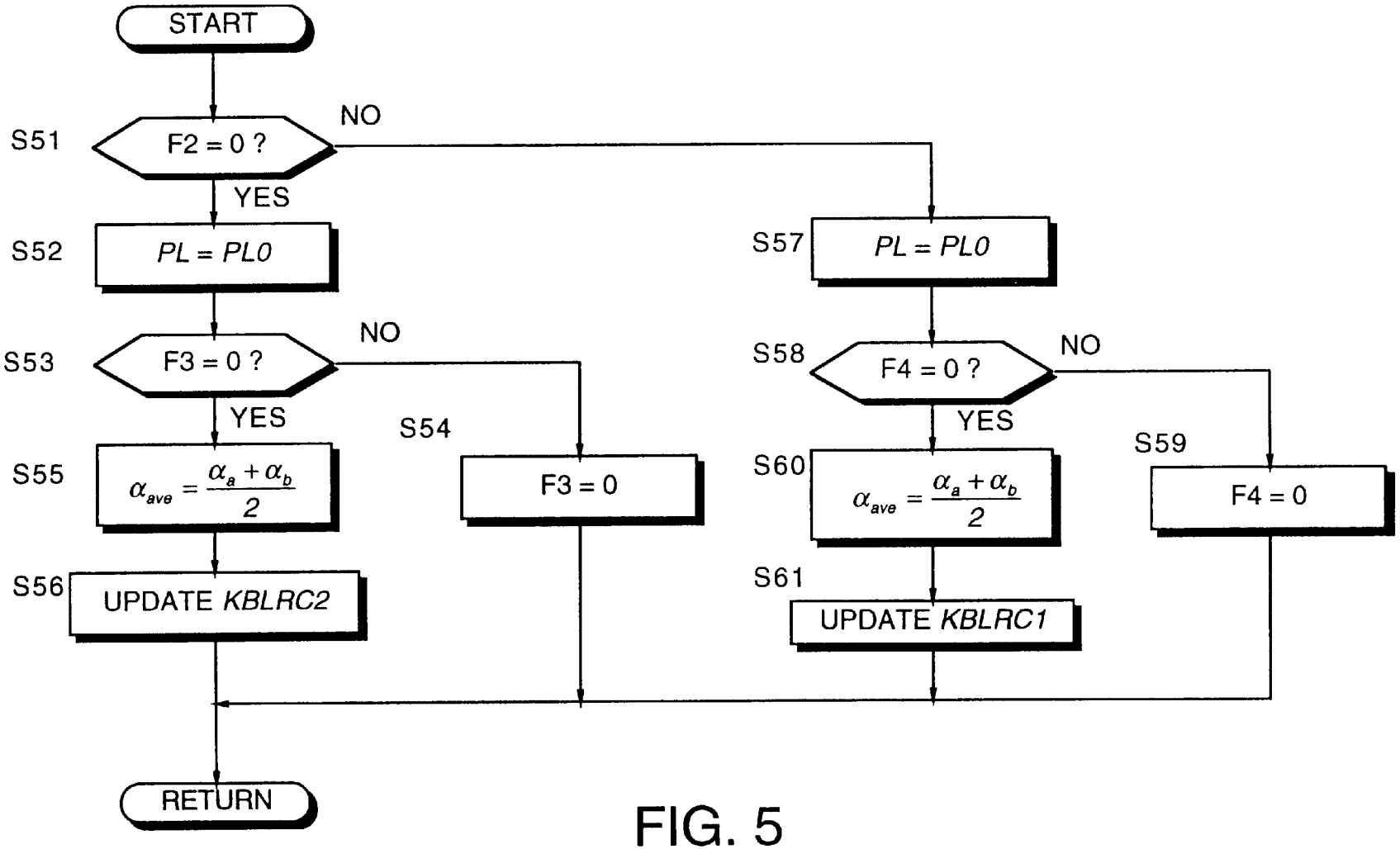
FIG. 5 is a flowchart for describing a first learning value update process performed by the air-fuel ratio controller.

Next, referring to a flowchart of FIG. 5, the first learning value update process performed in the step S31 will be described. The execution frequency of this process is equal to the execution frequency of the step S31, and therefore this process is executed each time the air-fuel ratio varies from rich to lean.

In this routine, steps S51–S56 are specific features according to this invention.

In the step S51, it is determined whether or not F2=0, i.e. whether or not the engine is in the high load region. When F2=0, the proportional amount PL is set equal to a predetermined value PL0 in a step S52.

In a step S53, it is determined whether or not the flag F3=0. The flag F3 is set to 1 in the steps S13 and S20 as described hereabove. In other words, the flag F3 is a flag which is set to 1 when air-fuel ratio feedback control conditions do not hold or the engine 1 is in the low load region. Therefore, when F3=1 in the step S53, it signifies that the engine 1 has entered the high load region for the first the. In this case, the flag F3 is reset to 0 in a step S54. On the next and subsequent occasions when the process for calculating the air-fuel ratio feedback correction coefficient α is executed, when the air-fuel ratio has inverted from rich to lean in the step S29, the process proceeds from the step S53 to the step S55 in the subroutine performed in the step S31.

In the step S55, an average $\alpha_{ave}$ of $\alpha_a$ and $\alpha_b$ is calculated.

In a step S56, a learning value KBLRC2 in the high load region is updated using $\alpha_{ave}$ by the following equation (1).

$$KBLRC2=KBLRC2(old)+M2\cdot(\alpha_{ave}-1) \quad (1)$$

where,

KBLRC2(old)=air-fuel ratio learning value in high load region before updating,

M2=updating proportion.

The updated learning value KBLRC2 is stored in a backup RAM in the control unit 2.

The updating proportion M2 is made a larger value than the updating proportion M1 of the learning value KBLRC1 in the low load region described hereafter. As there is only a short predetermined time for updating KBLRC2 in the high load region, there is a need to increase learning speed and make KBLRC2 converge rapidly. This is why M2 is set larger than M1.

Update of the learning value KBLRC2 is not performed when the air-fuel ratio has just inverted to lean from rich in the high load region for the following reason. The values of both $\alpha_a$ and $\alpha_b$ used in the step S55 must be values obtained in the high load region. However, the value of $\alpha_b$ just after the air-fuel ratio has inverted from rich to lean is a value before the engine 1 enters the high load region, i.e. a value in the low load region. When KBLRC2 is updated using this value, the precision of the learning value KBLRC2 falls. In order to avoid this, update of the learning value KBLRC2 is not performed in the high load region just after the air-fuel ratio has inverted from rich to lean.

When the engine is in the low load region, the proportional amount PL is set equal to a predetermined value P0 in the step S57.

In a step S58, it is determined whether or not the flag F4=0. The flag F4 is set to 1 in the steps S14 and S23 as described hereabove. In other words, the flag F4 is a flag which is set to 1 when air-fuel ratio feedback control conditions do not hold or the engine 1 is in the high load region. Therefore, when F4=1 in the step S55, it signifies that the engine 1 has entered the low load region for the first time. In this case, the flag F4 is reset to 0 in a step S59. Due to this, on the next and subsequent occasions when the air-fuel ratio feedback correction coefficient $\alpha$ is calculated, when the air-fuel ratio has inverted from rich to lean in the step S29, the process proceeds from the step S58 to a step S60 in the subroutine executed in the step S31.

In the step S60, the average $\alpha_{ave}$ of $\alpha_a$ and $\alpha_b$ is calculated.

In a step S61, a learning value KBLRC1 in the low load region is updated using $\alpha_{ave}$ by the following equation (2).

$$KBLRC1=KBLRC1(old)+M1\cdot(\alpha_{ave}-1) \quad (2)$$

where,

KBLRC1(old)=air-fuel ratio learning value in low load region before update,

M1=update proportion.

The updated learning value KBLRC1 is stored in a backup RAM in the control unit 2.

The reason why update of learning value KBLRC1 is not performed just after the air-fuel ratio has inverted from rich to lean in the low load region is as follows. The values of $\alpha_a$ and $\alpha_b$ used in the step S60 must both be values obtained in the low load region. However the value of $\alpha_b$ just after the air-fuel ratio has inverted from rich to lean is a value before the engine 1 enters the low load region. When KBLRC1 is updated using this value, the precision of the learning value KBLRC1 falls. In order to avoid this, update of the learned air-fuel ratio KBLRC1 in the low load region is not performed just after the air-fuel ratio has inverted from rich to lean.

Figure 6:
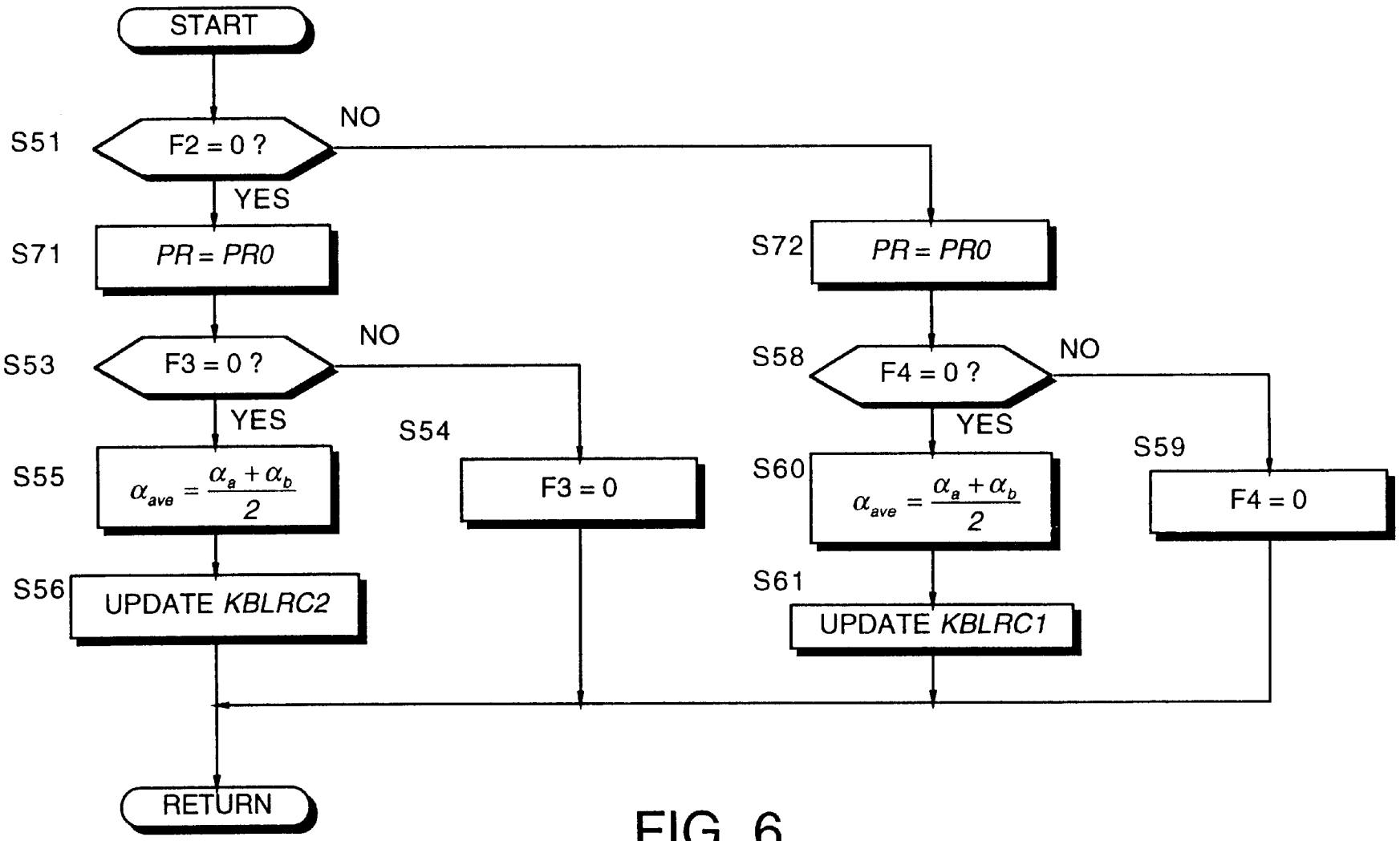
FIG. 6 is a flowchart for describing a second learning value update process performed by the air-fuel ratio controller.
Figure 7:
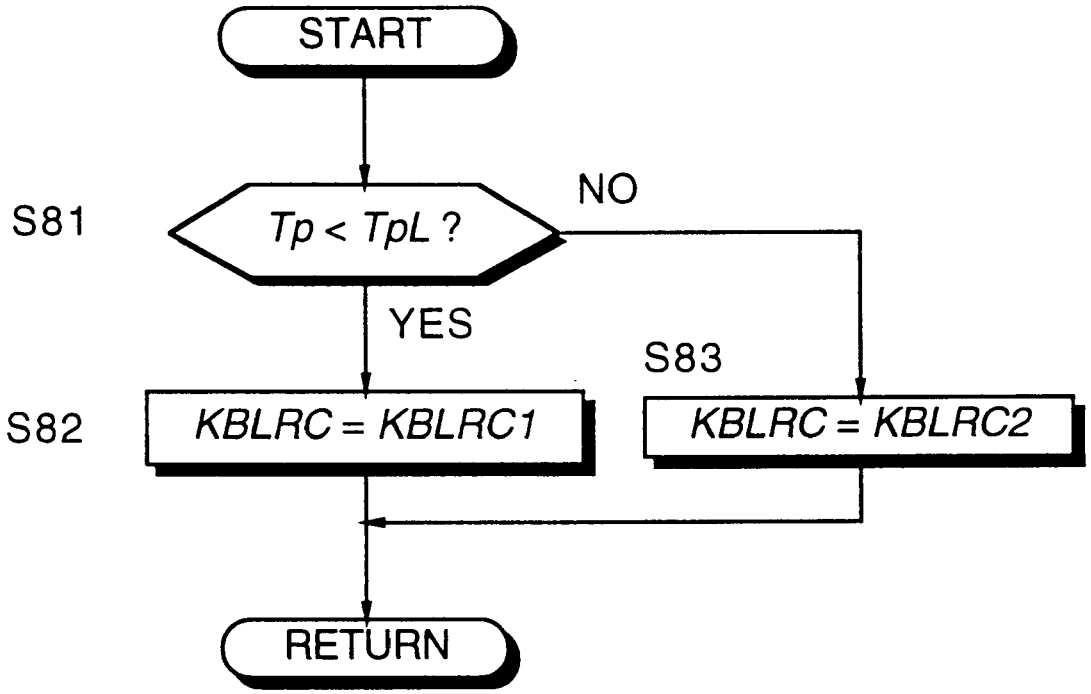
FIG. 7 is a flowchart for describing a process of determining an air-fuel ratio learning value KBLRC performed by the air-fuel ratio controller.

The process of updating the second learning value executed in the step S34 will now be described with reference to FIG. 6. The differences of this process from the first learning value update process are that the process is executed every time the air-fuel ratio varies from lean to rich, and also relate to the steps S71 and S72. Although the first learning value update process and the second learning value update process are mutually distinct processes, the same step number has been assigned to steps which perform the same processing.

In the steps S71 and S72, the proportional amount PR is set equal to the predetermined value PR0.

The predetermined value PR0 and the aforesaid predetermined value PL0 are respectively found from the engine rotation speed Ne and load Tp by referring to predetermined maps as is disclosed for example by the above-mentioned U.S. Pat. No. 5,255,662.

Next, the process of calculating the air-fuel ratio learning value KBLRC executed in the step S6 will be described. This process is executed at an interval of 10 milliseconds.

First, the predetermined value TpL is compared with the load Tp in a step S81.

When Tp<TpL, i.e. the engine 1 is in the low load region, the air-fuel ratio learning value KBLRC is set equal to the learning value KBLRC1 in the low load region in a step S82.

When Tp≧TpL, i.e. the engine is in the high load region, the air-fuel ratio learning value KBLRC is set equal to the learning value KBLRC2 in the high load region in a step S83.

The learning value KBLRC, unlike KBLRC1 and KBLRC2, is stored in an ordinary RAM, and is reset to 0 on engine startup.

The control performed by the above-mentioned air-fuel ratio control process will next be described referring to FIG. 8 and FIGS. 9A–9G. These figures show a case where the abovementioned control is applied to a system having the characteristic that the air-fuel ratio tends to be rich when the same air-fuel ratio correction coefficient is applied in the high load region as in the low load region.

Figure 8:
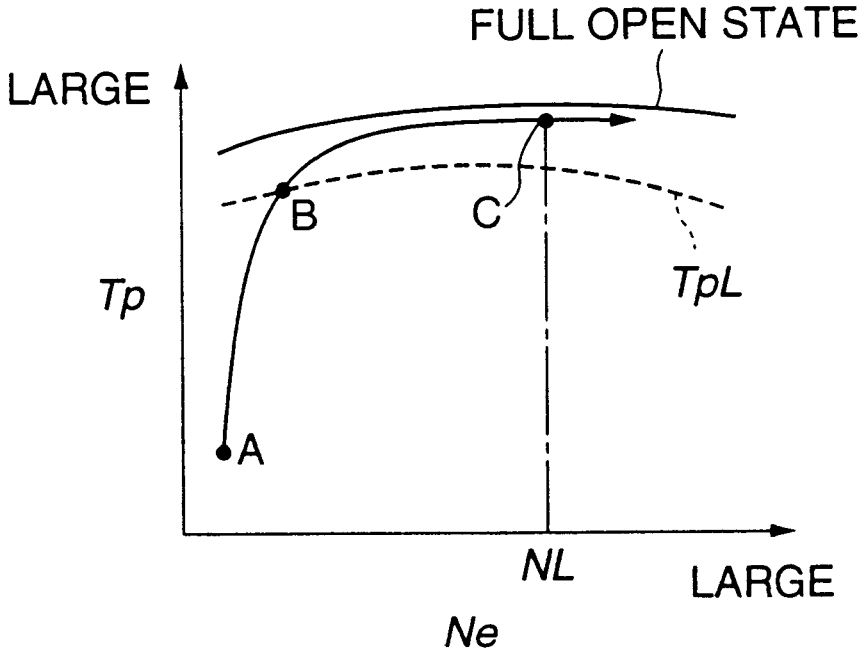
FIG. 8 is a diagram describing an ordinary engine running region.

When an accelerator pedal is depressed after feedback control of air-fuel ratio was started at a point a shown in FIG. 8, the engine 1 enters the high load region at a point B, and enters the high rotation speed region at a point C.

From point a to point B, the engine is in the low load region, the flag F2=1 and the usual air-fuel ratio feedback control and learning control are performed as shown in FIG. 9A.

When the engine 1 enters the high load region at the point B, the air-fuel ratio shifts to rich due to the above-mentioned characteristics. In this case, if air-fuel ratio feedback control is not performed in the high load region and open loop control of the air-fuel ratio is performed using the learning value KBLRC1 learned in the low, load region, the air-fuel ratio remains on the rich side for as long as high load conditions continue as shown by the solid line of FIG. 9C.

On the other hand, according to this controller, feedback control of the air-fuel ratio is performed by the above-mentioned process even in the high load region until the predetermined time TL elapses. As a result, the air-fuel ratio feedback correction coefficient $\alpha$ becomes smaller than 1.0, and the learning value KBLRC2 updated based on $\alpha$ also becomes smaller than the initial value of 1.0.

As described hereabove, as the update proportion M2 of KBLRC2 is set large, the learning value KBLRC2 converges in a short time.

After the predetermined time TL has elapsed, air-fuel ratio feedback control stops and the air-fuel ratio is controlled by an open loop using the learning value KBLRC2. The learning value KBLRC2 is a value learned in air-fuel ratio feedback control in the high load region, and by using this value, the air-fuel ratio is controlled precisely in the vicinity of the stoichiometric air-fuel ratio. As air-fuel ratio feedback control stops in a short time after entering the high load region, the possibility that surging of the engine 1 will occur due to air-fuel ratio feedback control is small.

The value of the learning value KBLRC2 is stored in a backup RAM, and it is applied again to air-fuel ratio feedback correction in the high load region on the next occasion the vehicle runs. Due to this, convergence of the learning value is even more rapid. Also, as air-fuel ratio feedback correction is performed whenever the engine 1 enters the high load region, the air-fuel ratio can quickly be controlled to the stoichiometric air-fuel ratio even when the flowrate characteristics of the fuel injection valve vary.

FIGS. 10A–13 show a second embodiment of this invention.

According to this embodiment, the proportional amount and integral amount of the air-fuel ratio feedback correction coefficient a used in the high load region of the engine 1 are set to different values from the proportional amount and integral amount in the low load region of the engine 1. Specifically, the proportional amount used in the high load region is set smaller than the proportional amount used in the low load region, and the integral amount used in the at high load region is set smaller than the integral amount used in the low load region.

Figure 10A:
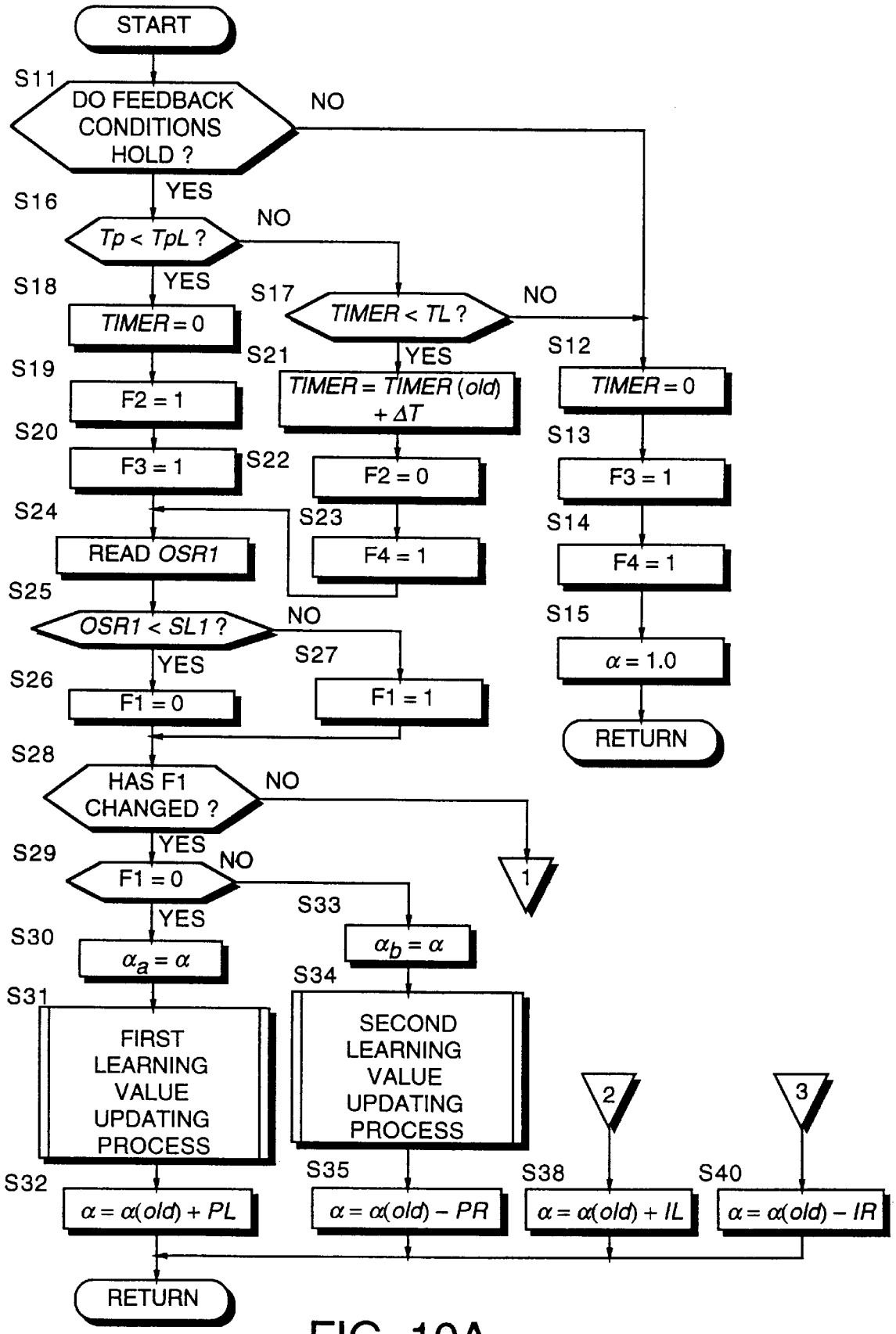
FIGS. 10A and 10B are flowcharts for describing a process for computing the air-fuel ratio feedback correction coefficient $\alpha$ according to a second embodiment of this invention.
Figure 10B:
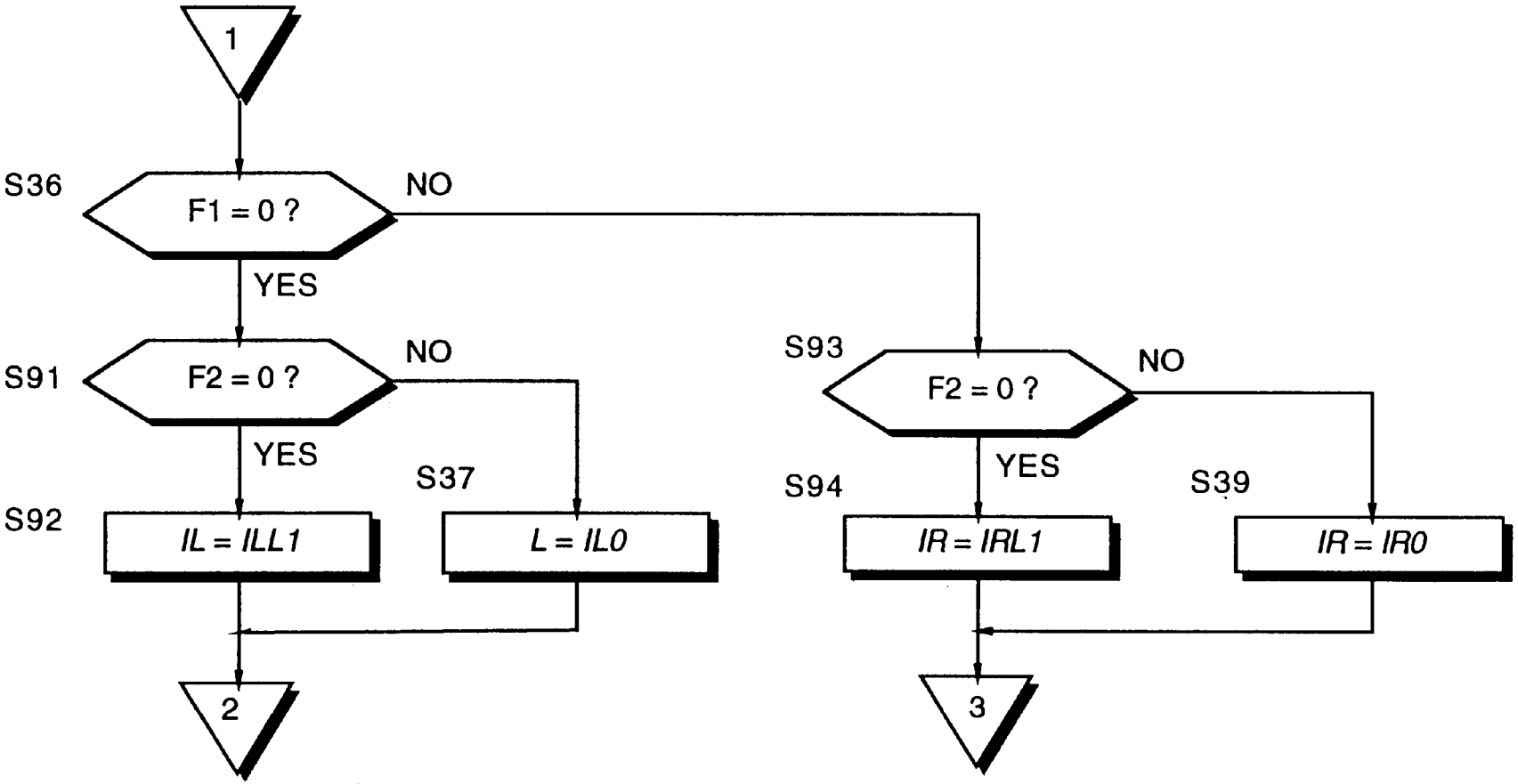

Therefore, the process of computing the air-fuel ratio feedback correction coefficient $\alpha$ shown in FIGS. 10A and 10B is applied instead of the process of FIG. 3 of the first embodiment. The first learning value update process of FIG. 11 is applied instead of the process of FIG. 5, and the second learning value update process of FIG. 12 is applied instead of the process of FIG. 6.

Figure 11:
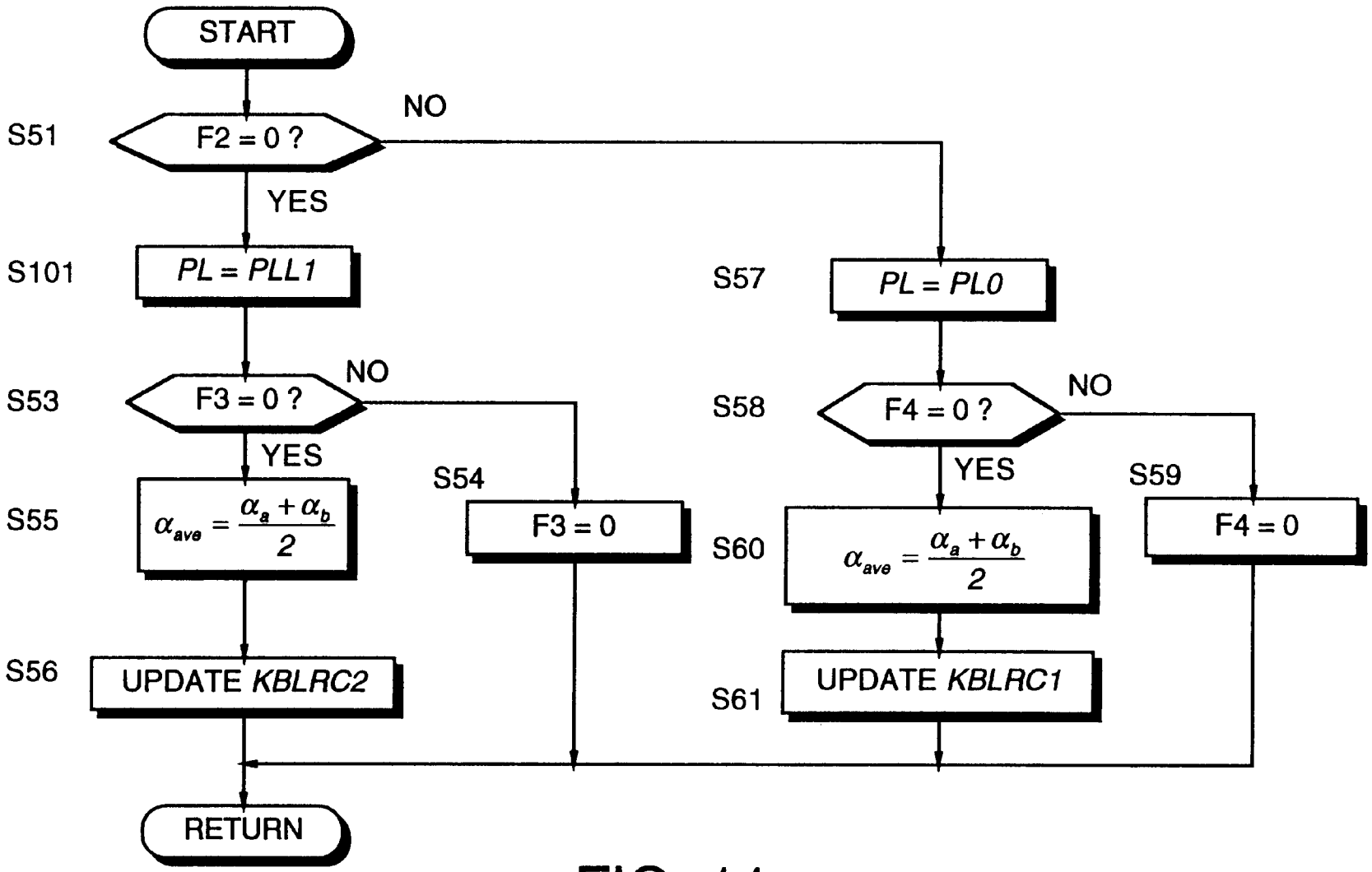
FIG. 11 is a flowchart for describing a first learning value update process according to the second embodiment of this invention.
Figure 12:
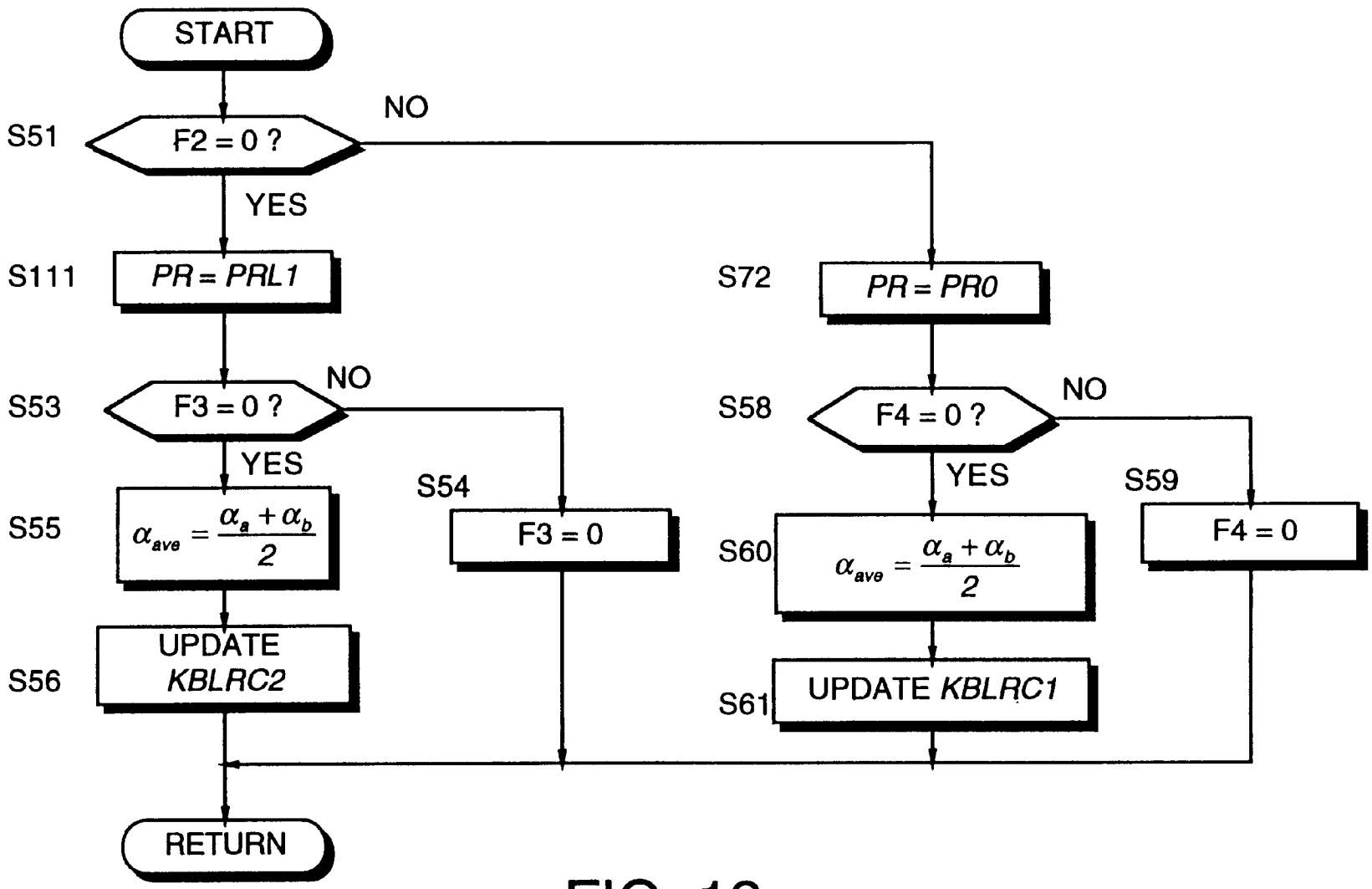
FIG. 12 is a flowchart to describe the second learning value update process by the second embodiment of this invention.

In these embodiments, steps which are different from those of the first embodiment or new steps are steps S91–S94 of FIGS. 10A and 10B, a step S101 of FIG. 11 and a step of FIG. 12.

In the step S36 of FIG. 10B, F1=0, i.e. when the air-fuel ratio is lean, it is determined in a step S91 whether or not the engine 1 is in the high load region.

When F2=0, i.e. when the engine 1 is in the high load region, the integral amount IL is set equal to a predetermined value ILL1 in the step S92. When F2=1, the integral amount IL is set equal to the predetermined value IL0 in the step S37 as in the case of the first embodiment.

In the step S36, when F1=1, i.e. when the air-fuel ratio is rich, it is determined whether or not the engine 1 is in the high load region 1 in the step S93.

When F2=0, i.e. when the engine 1 is in the high load region, the integral amount IR is set equal to the predetermined value IRL1 in the step S94. When F2=1, the integral amount IR is set equal to the predetermined value IR0 in the step S39.

In the first learning value update process of FIG. 11, the step S101 is provided instead of the step S52. Here, the proportional amount PL is set equal to the predetermined value PLL1.

In the second learning value update process of FIG. 12, the step S111 is provided instead of the step S52. Here, the proportional amount PR is set equal to the predetermined value PRL1.

Figure 13:
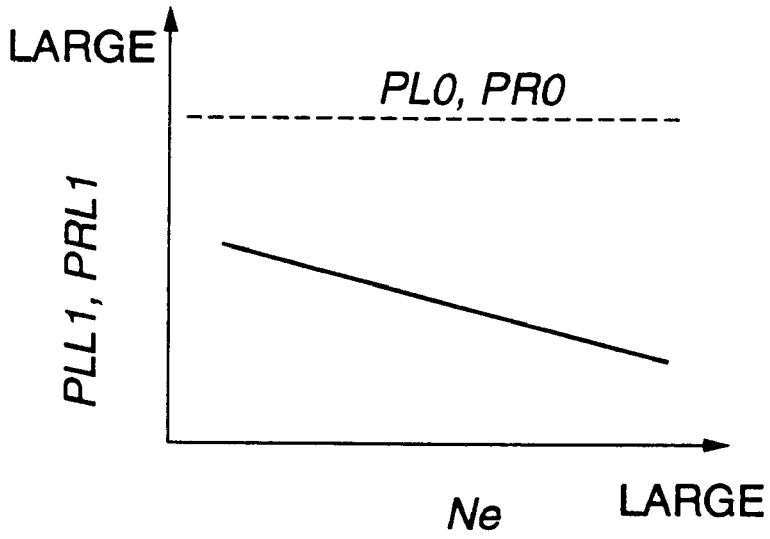
FIG. 13 is a diagram showing the contents of a table of predetermined values PLL1, PRL1 according to the second embodiment of this invention.

The characteristics of the predetermined values PLL1 and PRL1, which are proportional amounts for the high load region, are shown in FIG. 13. Specifically, the predetermined values PLL1, PRL1 are smaller than the predetermined values PL0, PR0 which are proportional amounts for the low load region. The predetermined values PLL1, PRL1 are also set larger the lower the engine rotation speed Ne.

Figure 14:
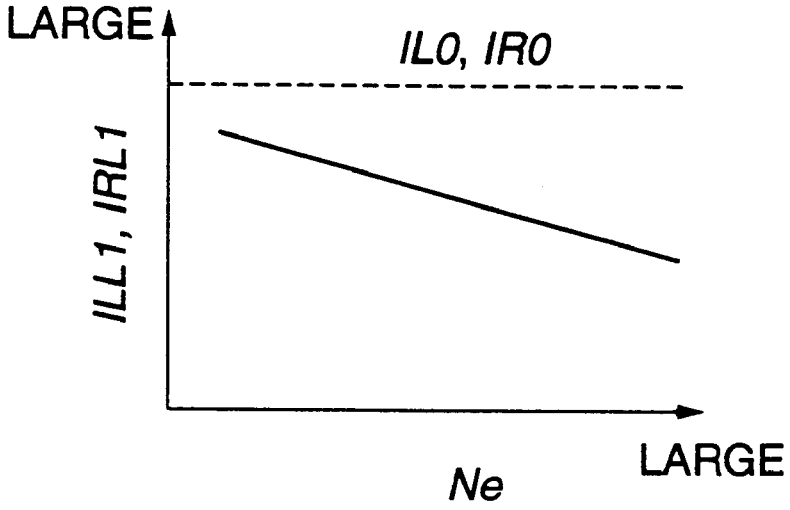
FIG. 14 is a diagram showing the contents of a table of predetermined values ILL1, IRL1 according to the second embodiment of this invention.

The characteristics of the predetermined values ILL1, IRL1 which are integral amounts for the high load region are shown in FIG. 14. Specifically, the predetermined values ILL1, IRL1 are smaller than the predetermined values IL0, IR0, and the predetermined values ILL1, IRL1 are set larger the lower the engine rotation speed Ne.

The reason why the proportional amount and integral amount are set lower in the high load region than in the low load region of the engine 1 is as follows.

To suppress torque change which has a large effect on surging in the high load region, the period of the air-fuel ratio feedback control should be long, and the amplitude of the air-fuel ratio should be small. For this reason, the proportional amounts PL, PR and the integral amounts IL, IR must be made small. This is due to the fact that when the proportional amounts PL, PR are made small, the air-fuel ratio feedback control period gets longer, and when the integration amounts IL, IR are made small, the amplitude of the air-fuel ratio is small.

However, when the integral amounts IL, IR are made small, the air-fuel ratio feedback control period also shortens, so the integral amounts IL, IR cannot be made too small.

A desirable anti-surging effect is obtained when the predetermined values PLL1, PRL1 are both set to around ⅕ of the predetermined values PL0, PR0, and the predetermined values ILL1, IRL1 are both set to around ½ of the predetermined values IL0, IR0.

However, the object of performing air-fuel ratio feedback control in the high load region is to make the exclusive high load region learning value KBLRC2 converge. As the learning value KBLRC2 is updated when the air-fuel ratio exceeds the slice level and the air-fuel ratio feedback control period becomes longer, the opportunity for updating decreases and the convergence of KBLRC2 is delayed.

Therefore in order to achieve the dual objectives of convergence of KBLRC2 and control of surging, the predetermined values PLL1, PRL1 are respectively set larger than ⅕ of PL0 and ⅕ of PR0. and the predetermined values ILL1, RL1 are respectively set larger than ½ of IL0 and ½ of IR0, as shown in FIGS. 13 and 14.

The predetermined values PLL1, PRL1 are relatively large when the engine rotation speed Ne is low, and the predetermined values ILL1, IRL1 are also relatively large when the engine rotation speed Ne is low. This is because the air-fuel ratio feedback control period is long and the air-fuel ratio amplitude is small for low rotation speeds, so there is no need to make the proportional amount and integral amount small as for the high rotation speed region.

In FIG. 13, PLL1 is set equal to PRL1 and PL0 is set equal to PR0, but PLL1 may be different from PRL1 and PL0 may be different from PR0. Similarly, in FIG. 14, ILL1 is set equal to IRL0 and IL0 is set equal to IR0, but ILL1 maybe different from IRL1 and IL0 may be different from IR0.

Figures 15A, 15B:
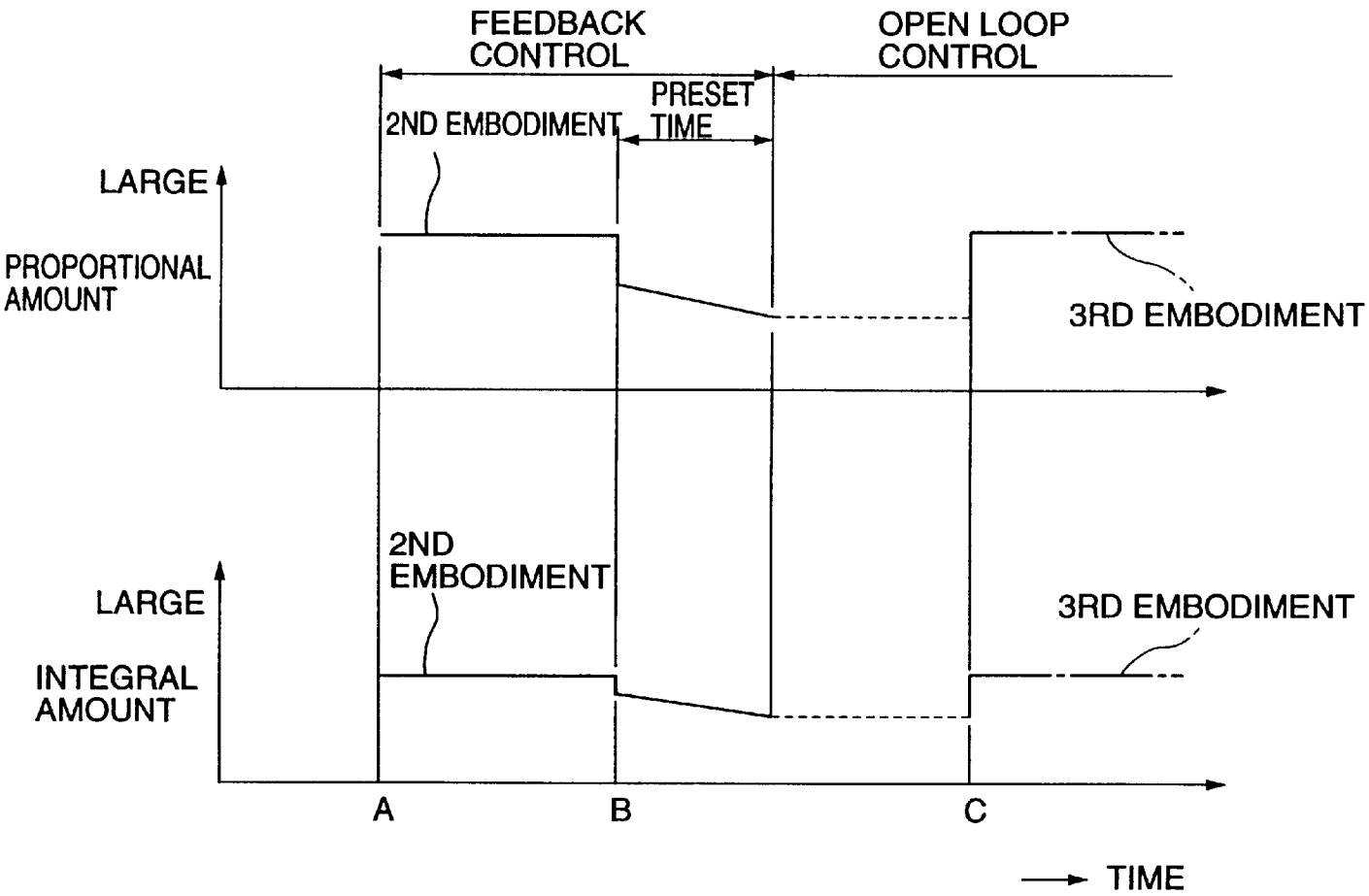
FIGS. 15A and 15B are timing charts showing a variation of a proportional amount and an integral amount according to the second embodiment of this invention, and a variation of the proportional amount and integral amount according to a third embodiment of this invention.

FIGS. 15A and 15B show how the proportional amount and integral amount of the second embodiment vary when running conditions vary as shown in FIG. 8. At point B when the engine 1 enters the high load region, the proportional amount and integral amount become smaller than their values in the low load region. This is because the predetermined values PLL1, PRL1, ILL1 and RL1 which specify the proportional amount and integral amount in the high load region decrease according to engine rotation speed.

Actually, the proportional amount and integral amount vary also in the low load region between A–B, but this change has been shown in the figures by a constant value because this is not related to the present invention.

According to the second embodiment, as the proportional amount and integral amount used for air-fuel ratio feedback control in the high load region were set smaller than the proportional amount and integral amount used for air-fuel ratio feedback control in the low load region, the control period of the air-fuel ratio becomes longer and the amplitude becomes smaller. As a result, the deterioration of drivability of the vehicle during the learning control is prevented.

FIGS. 16A–18 show a third embodiment of this invention.

According to this embodiment, not only the load of the engine 1, but also the engine rotation speed Ne is added to the air-fuel ratio feedback control conditions. Specifically, provided that the engine rotation speed is not in a specific low speed region, the proportional amount and integral amount for low load are applied to perform air-fuel ratio feedback control even when the engine is in the high load region. As almost no surging is experienced in the high load, non-low rotation speed region, a problem does not occur even if ordinary air-fuel ratio feedback control is performed. The reason why the proportional amount and integral amount of the low load region are used is that increasing the proportional amount and integral amount is advantageous for purifying the exhaust provided that the vehicle drivability does not deteriorate.

Figure 16A:
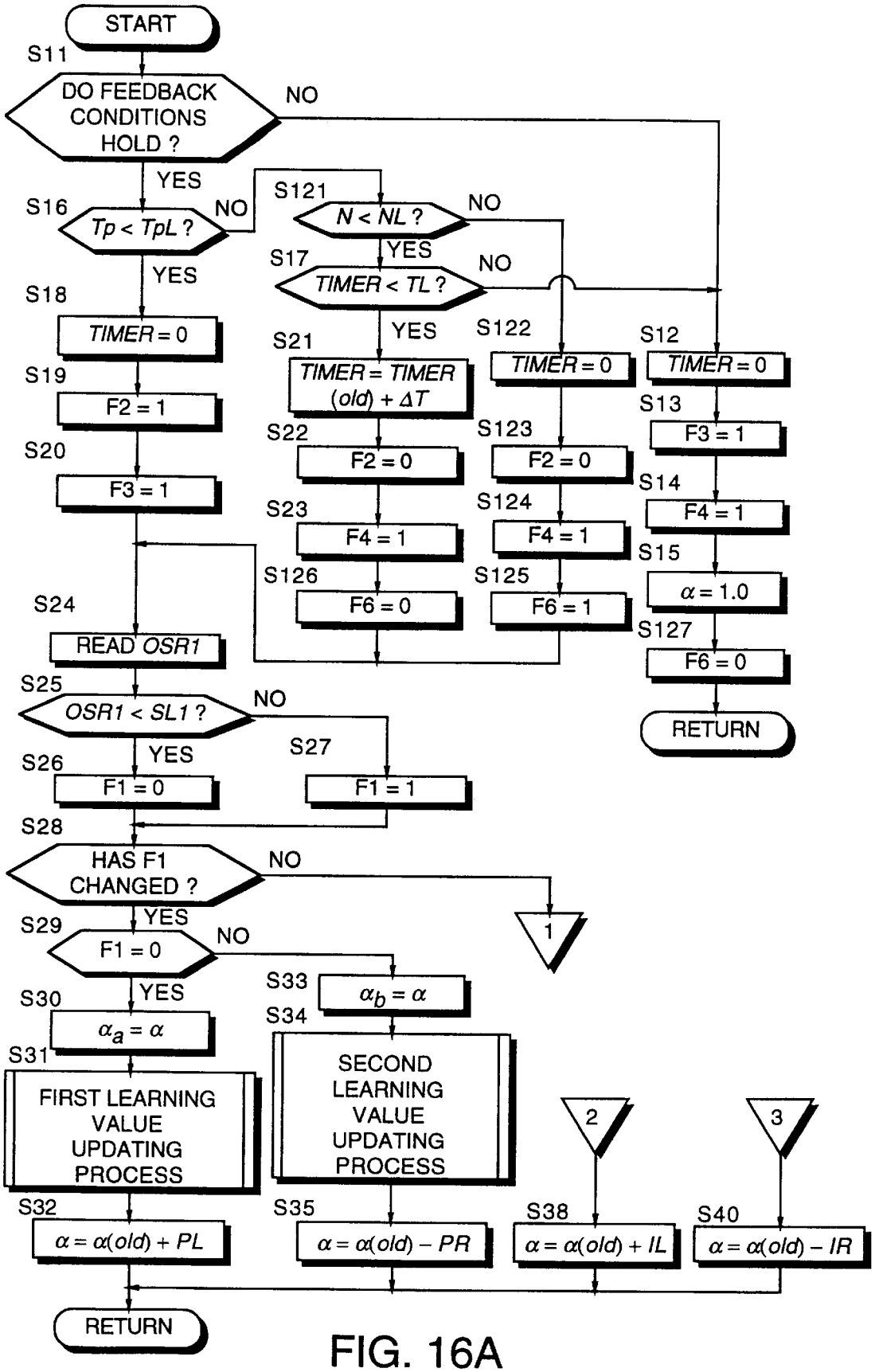
FIGS. 16A and 16B are similar to FIGS. 10A and 10B, but showing the third embodiment of this invention.
Figure 16B:
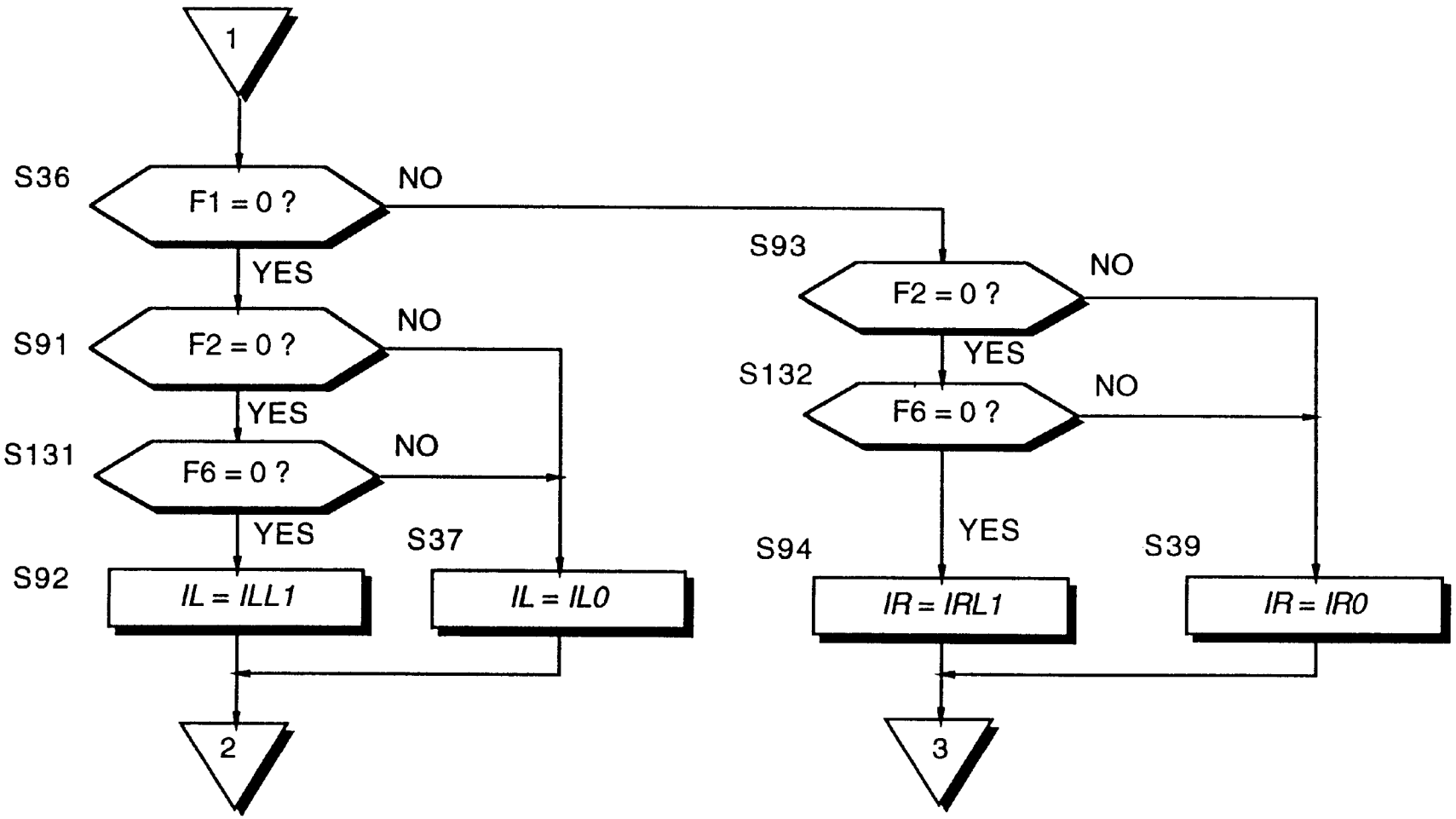
Figure 17:
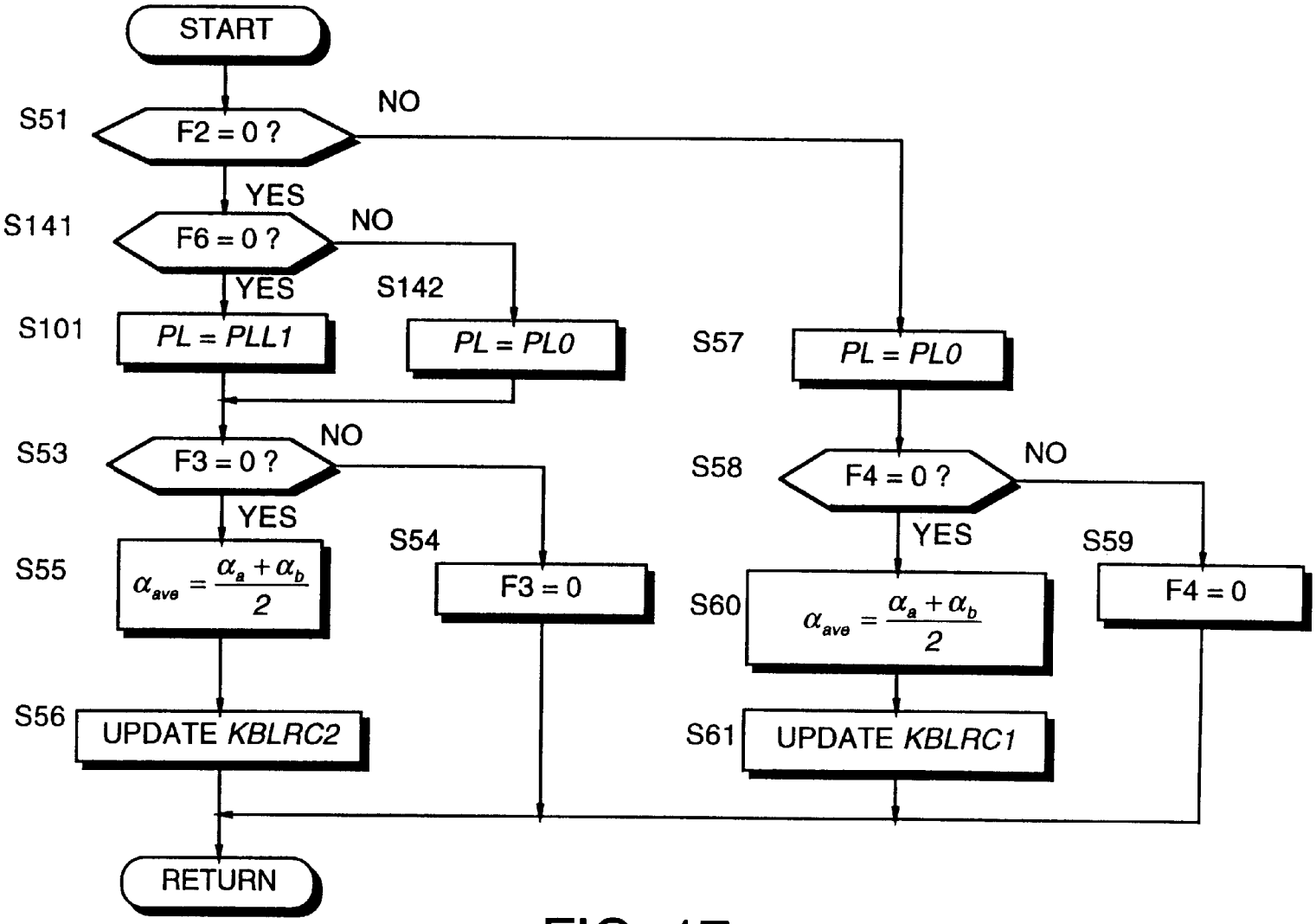
FIG. 17 is similar to FIG. 11, but showing the third embodiment of this invention.
Figure 18:
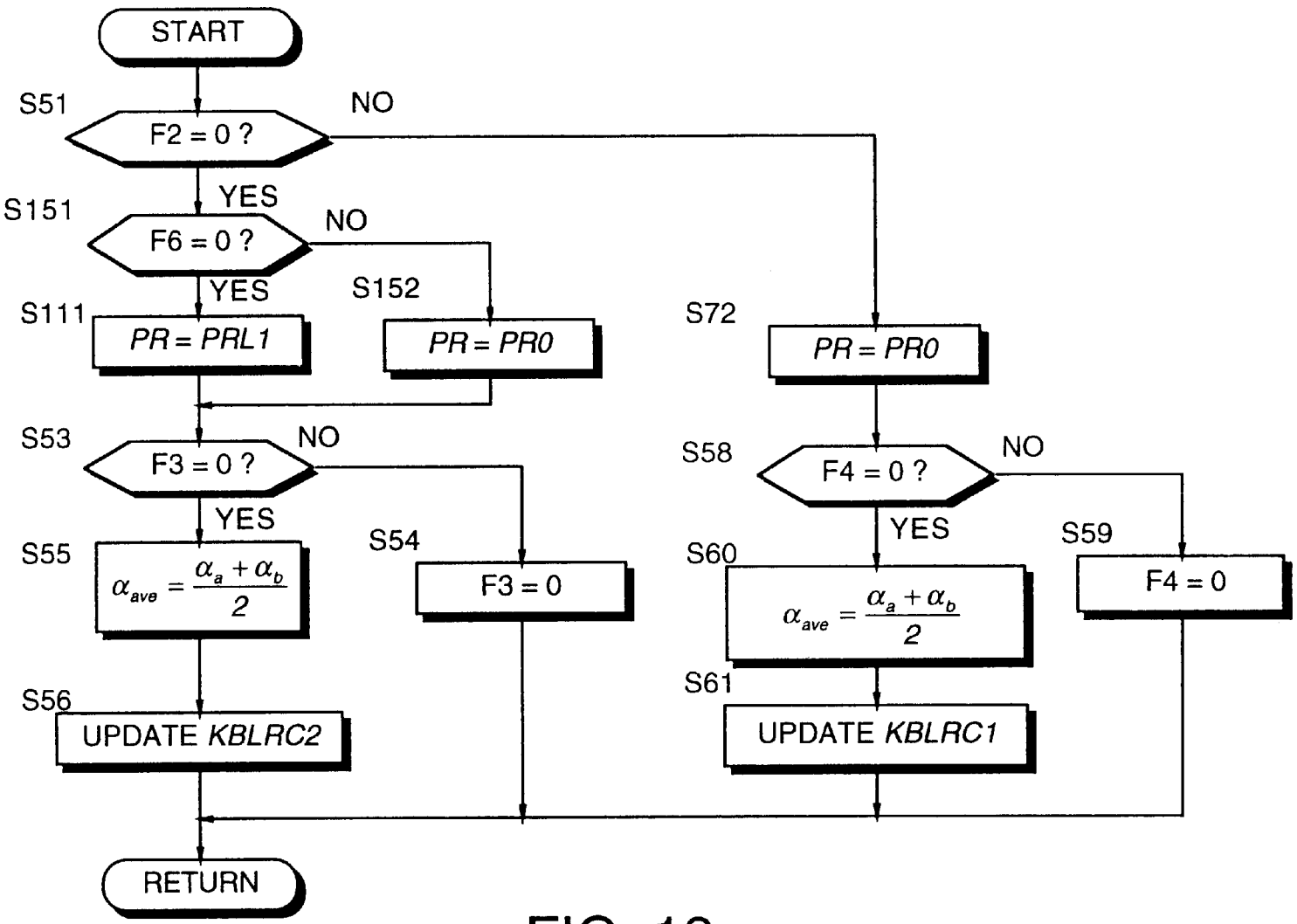
FIG. 18 is similar to FIG. 12, but showing the third embodiment of this invention.

FIGS. 16A, 16B are equivalent to FIGS. 10A, 10B of the second embodiment, FIG. 17 corresponds to FIG. 11 of the second embodiment, and FIG. 18 is equivalent to FIG. 12 of the second embodiment.

Differences from the second embodiment are steps S121–S126 and steps S131, S132 of FIGS. 16A, 16B, step S141 of FIG. 17 and step S151 of FIG. 18.

In FIGS. 16A and 16B, the step S121 is interposed between the steps S16 and S17. Here, the predetermined value NeL is compared with the engine rotation speed Ne, the processing of the step S17 and subsequent steps is performed provided that the engine is in the low rotation speed region where Ne<NeL, and the flag F6 is reset to 0. The predetermined value NeL may be set to, for example, 3000 rpm. The flag F6 is a flag distinguishing whether or not the engine 1 is in the low rotation speed region, and it is initialized to 0 on engine startup.

Even when air-fuel ratio feedback control conditions do not hold in the step S11, after having performed the processing of the steps S12–S15, the flag F6 is reset to 0 in a step S127.

In the step S121, when Ne≧NeL, i.e. when the engine 1 is in the non-low rotation speed region, 0 is entered in the TIMER value TIMER in the step S122, the same operations as those of the step S22, S23 are performed in the steps S123, S124, and 1 is entered in F6 in the step S125.

In the steps S91, S131, F2=0 and F6=1, i.e. in the high load, non-low rotation speed region, the routine proceeds to the step S37, and the integral amount IL is set equal to the predetermined value IL0.

Similarly, in the steps S93, S132, when F2=0 and F6=1, the routine proceeds to the step S39, and the integral amount IR is set equal to the predetermined value IR0.

When, in the first learning value update process of FIG. 17, F2=0, i.e. when it is determined that the engine 1 is in the high load region, it is determined whether or not F6 is 0 in the step S141. When F6=1 in the step S141, the engine 1 is in the high load, non-low rotation speed region. In this case, the proportional amount PL is set equal to the predetermined value PL0 in a step S142 as in the case of the low load.

When, in the second learning value update process of FIG. 18, F2=0, i.e. when it is determined the engine 1 is in the high load region in the step S51, it is determined whether or not F6 is 0 in the step S151. When F6=1 in the step S151, the engine 1 is in the high load, non-low rotation speed region, and in this case, the proportional amount PR is set equal to the predetermined value PR0 in the step S15 as in the case of low load.

As a result according to this embodiment, as shown in FIGS. 15A, 15B, when the rotation speed is in the non-low rotation speed region, for example at point C, and even when the engine 1 is in the high load region, feedback control of air-fuel ratio is again performed and update of the learning value KBLRC2 is also performed in this state.

As a result, after point C, the proportional amount and integral amount have the same size between a–B in the low load region as shown by the dot-and-dash line of the figure. Actually, the proportional amount and integral amount vary according to the engine rotation speed Ne after point C, but are shown as a constant value in order to simplify the description.

In this way, by performing air-fuel ratio feedback control in the high load, high rotation speed region where surging is almost hardly felt, the air-fuel ratio feedback control region is extended and exhaust performance is remarkably improved.

FIGS. 19A–22B show a fourth embodiment of this invention.

According to the fourth embodiment, air-fuel ratio feedback control is performed using an extremely small proportional amount and integral amount instead of stopping air-fuel ratio feedback control when the predetermined time TL has passed after the engine 1 has entered the high load region.

Figure 19A:
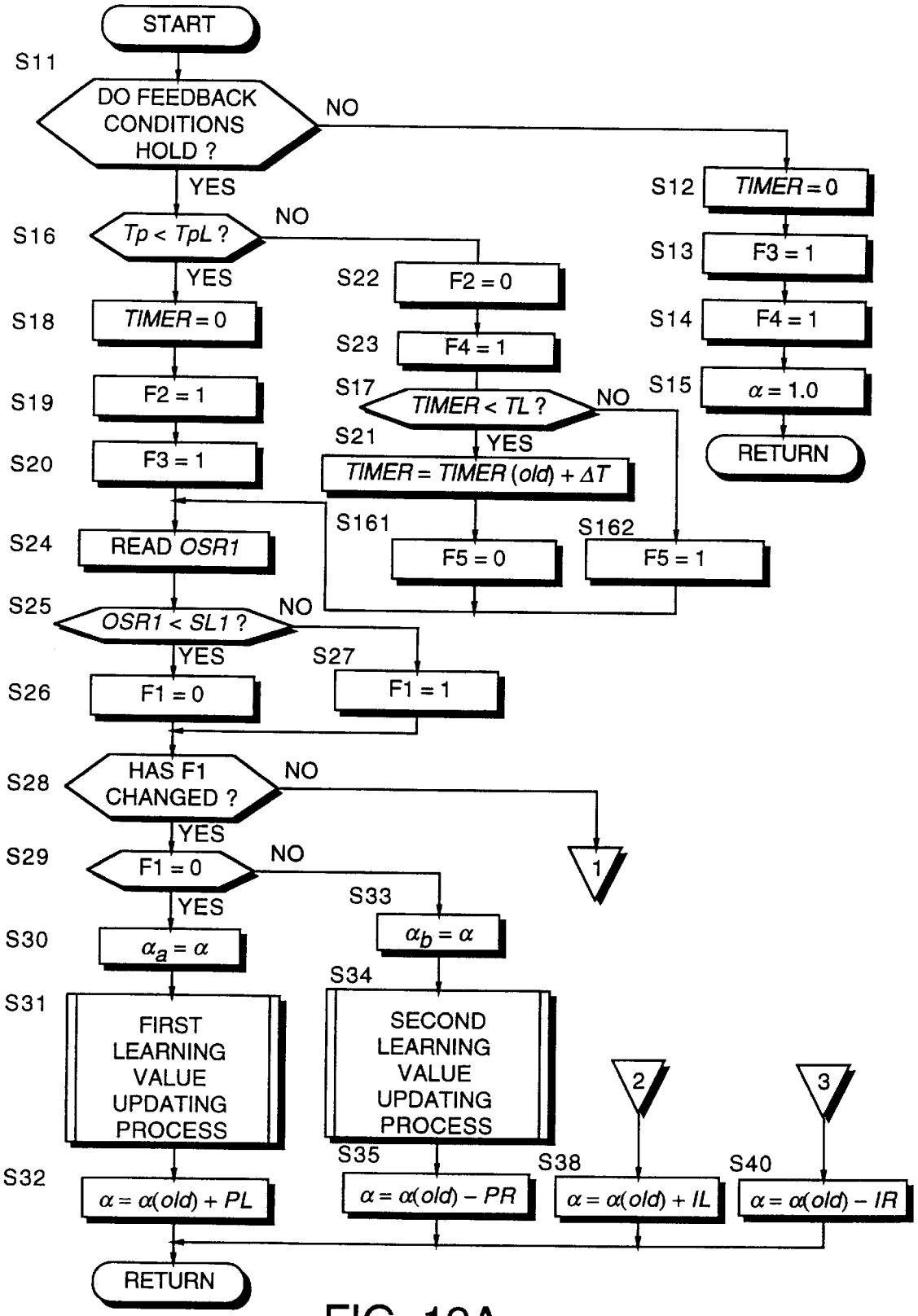
FIGS. 19A and 19B are similar to FIGS. 10A and 10B, but showing a fourth embodiment of this invention.
Figure 19B:
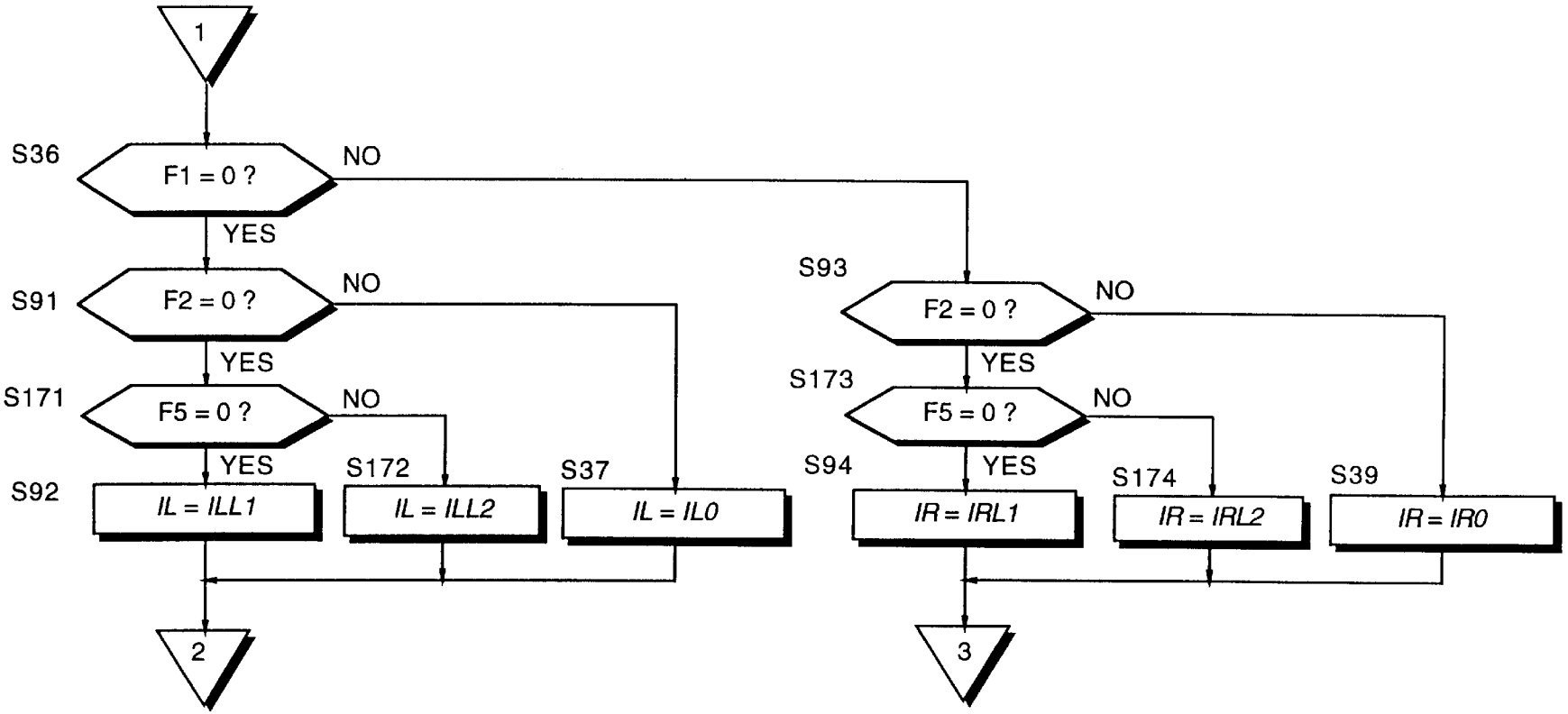
Figure 20:
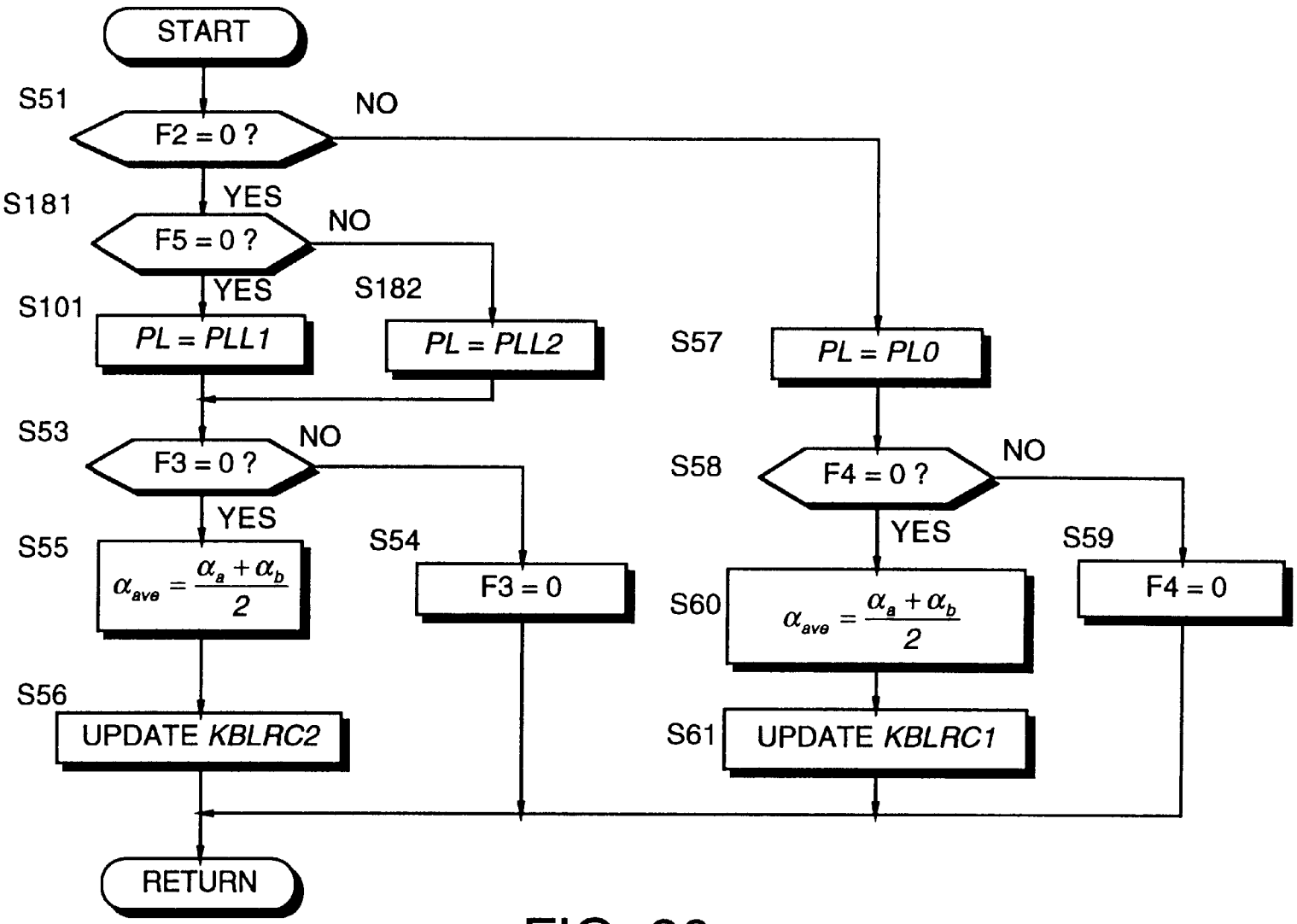
FIG. 20 is similar to FIG. 11, but showing a fourth embodiment of this invention.
Figure 21:
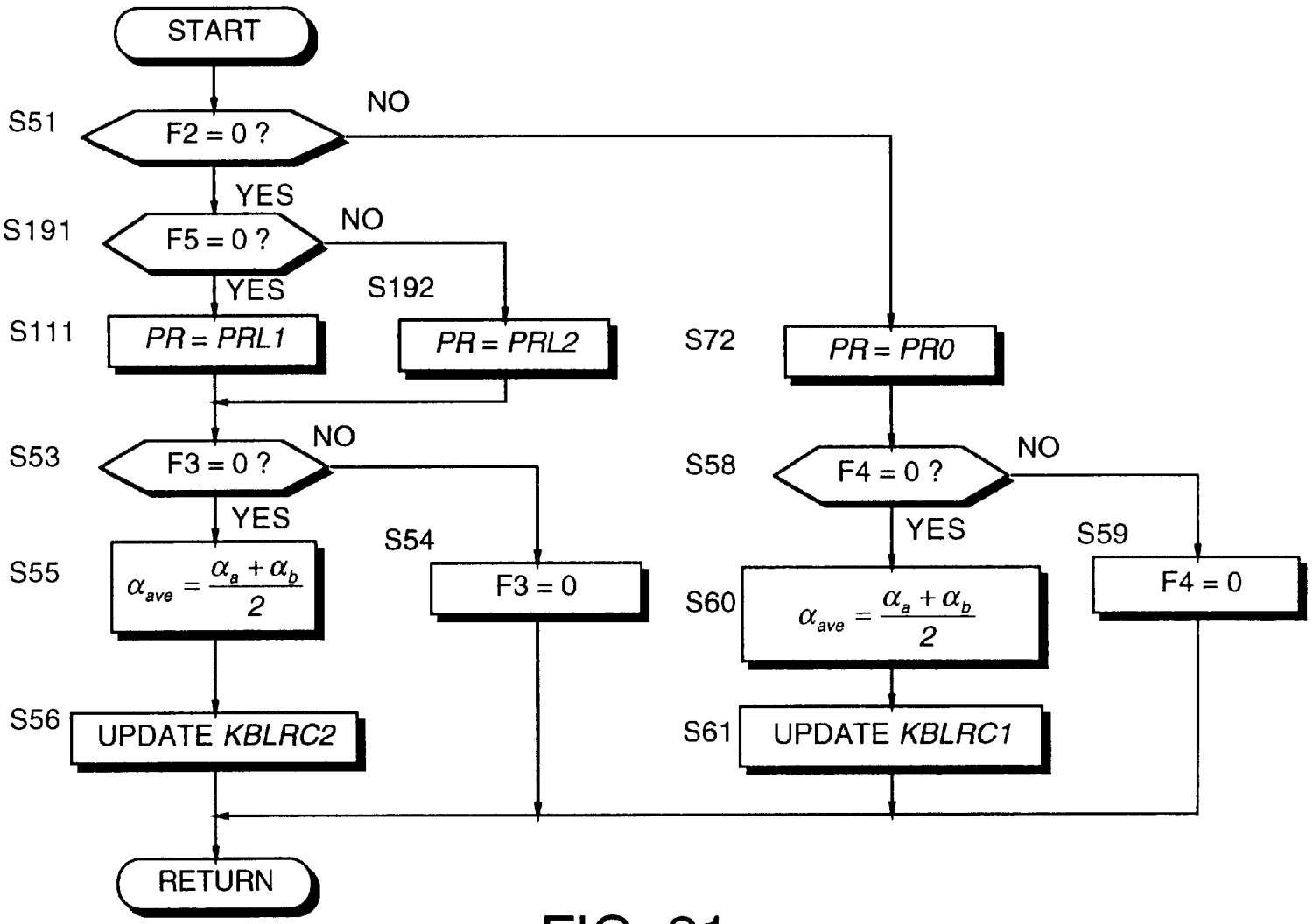
FIG. 21 is similar to FIG. 12, but showing the fourth embodiment of this invention.
Figures 22A, 22B:
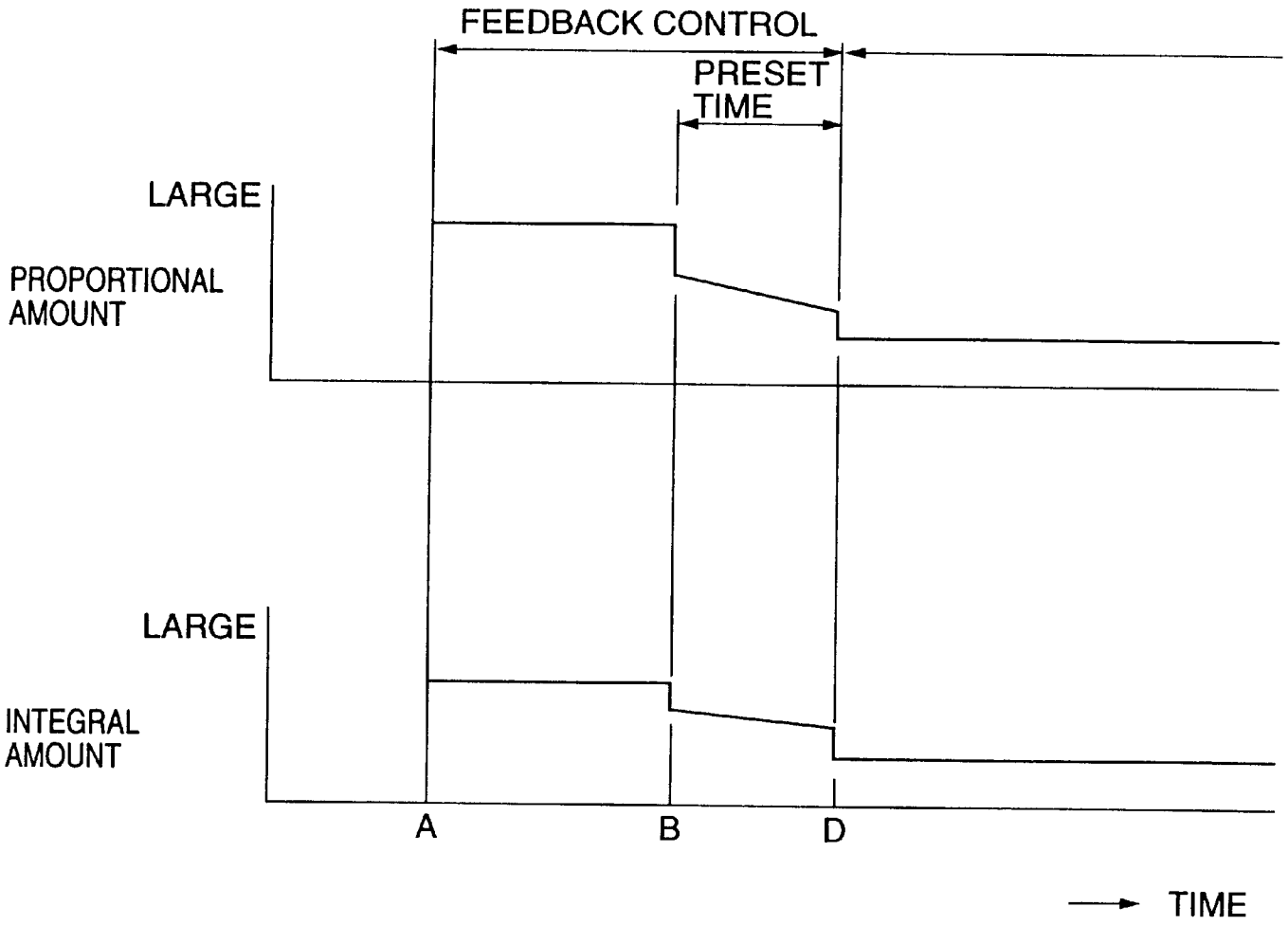
FIGS. 22A and 22B are timing charts showing a variation of the proportional amount and integral amount according to the fourth embodiment.

FIGS. 19A, 19B corresponds to FIGS. 10A, 10B of the second embodiment, FIG. 20 corresponds to FIG. 11 of the second embodiment, and FIG. 12 corresponds to FIG. 11 of the second embodiment. FIGS. 22A, 22B correspond to FIGS. 15A and 15B.

Differences from the second embodiment are that the step S17 is shifted after the steps S22, S23, and the new steps S161, S162 are provided in FIG. 19A.

When TIMER<TL in the step S17, the flag F5 is reset to 0 in the step S161, and when TIMER≧TL, the flag F5 is set to 1 in the step S162.

When the flag F5=1, it shows that the predetermined time TL has elapsed since the running state of the engine 1 entered the high load region, and when F5=0, it shows that the predetermined time TL has not elapsed since the running state of the engine 1 entered the high load region. The flag F5 is initialized to 0 on engine startup.

When F2=0 and F5=1 in the step S91 and S171 in FIG. 19B, the routine proceeds to a step S172 and the integral amount IL is set equal to the predetermined value ILL2. Similarly, when F2=0 and F5=1 in the steps S93 and S173, the routine proceeds to a step S174, and the integration amount IR is set equal to the predetermined value IRL2.

When F2=0 and F5=1 in the steps S51 and S181 of FIG. 20, the proportional amount PL is, set equal to the predetermined value PLL2 in the step S182. Similarly, when F2=0 and F5=1 in the steps S51 and S191 of FIG. 21, the proportional amount PR is set equal to the predetermined value PRL2 in a step S192.

The predetermined values PLL2, PRL2 are respectively set equal to ⅕ of PL0 and ⅕ of PR0, and the predetermined values ILL2, IRL2 are respectively set equal to ½ of IL0 and ½ of IR0.

The reason why air-fuel ratio feedback control is performed using an extremely small proportional amount and integral amount after the predetermined time TL has elapsed after the engine 1 entered the high load region, is that when air-fuel ratio feedback control in high load region is stopped for a long period, and an external disturbance occurs during the stopping period, the air-fuel ratio may deviate from the stoichiometric air-fuel ratio, and this deviation of air-fuel ratio can be absorbed by performing air-fuel ratio feedback control. Another reason is that after the time TL has elapsed after entering the high load region, the learning value KBLRC2 has already converged, and from the sole viewpoint of preventing surging, the predetermined values PLL2, PRL2, ILL2, IRL2 can be set very small.

In this fourth embodiment, a change of proportional amount and integral amount when the accelerator pedal is depressed as shown in FIG. 8, is shown in FIGS. 22A and 22B.

At a point D and beyond after the predetermined time TL has elapsed after the running state of the engine 1 has entered the high load region, the proportional amount and integral amount become extremely small. Air-fuel ratio control is therefore performed with a long control period and a small amplitude.

In this way, according to the fourth embodiment, a deviation of air-fuel ratio due to prolonged air-fuel ratio feedback control in the high load region or a deviation of air-fuel ratio due to an external disturbance does not easily occur. Due to this, the exhaust purification capacity in the high load region is remarkably improved.

In the above-mentioned embodiments, the third embodiment was described in the context of its application to the second embodiment, but the third embodiment may also be applied to the first embodiment. Also, the fourth embodiment was described in the context of its application to the second embodiment, but the fourth embodiment may also be applied to the first embodiment and the third embodiment.

In all of the above-mentioned embodiments, air-fuel ratio control is performed for the predetermined time TL after the engine 1 enters the high load region, but it is understood that the predetermined time may be determined also by counting the number of engine rotations from when the engine enters the high load region to when a predetermined value is reached.

The corresponding structures, materials, acts, and equivalents of all means plus function elements in the claims below are intended to include any structure, material, or acts for performing the functions in combination with other claimed elements as specifically claimed. The embodiments of this invention in which an exclusive property or privilege is claimed are defined as follows:

What is claimed is:

1. An air-fuel ratio controller for controlling an air-fuel ratio of an air-fuel mixture supplied to an engine, comprising:

a fuel injection valve to inject fuel into the engine;

an oxygen sensor to detect an oxygen concentration in an exhaust of the engine, and a microprocessor programmed to:

calculate a basic in section amount based on a running condition of the engine;

calculate a feedback correction amount based on the oxygen concentration so that the air-fuel ratio is controlled to be a predetermined air-fuel ratio;

store a learning value for a high load state, the learning value being calculated for a predetermined time based on the feedback correction amount when the high load state is developed, wherein the predetermined time is a time required to converge the learning value;

clamp the feedback correction amount in the high load state after the predetermined time has elapsed; and calculate a fuel injection amount by correcting the basic injection amount with the learning amount for the high load state when the engine is in the high load state, wherein the fuel injection amount is injected from the fuel injection valve.

2. The air-fuel ratio controller as defined in claim 1, wherein the microprocessor is further programmed to release the clamp of the feedback correction amount in the high load state when an engine rotation speed has risen to a high speed region after the predetermined time has elapsed.

3. The air-fuel ratio controller as defined in claim 1, wherein the microprocessor is further programmed to store a second learning value calculated based on the feedback correction amount when the engine is in a state other than the high load state, and correct the basic injection amount with the second learning value when the engine is in the state other than the high load state.

4. The air-fuel ratio controller as defined in claim 3, wherein the microprocessor is further programmed to calculate a feedback correction amount by using a proportional amount and an integral amount, and the proportional amount used in the high load state is smaller than the proportional amount used in the state other than the high load state.

5. The air-fuel ratio controller as defined in claim 3, wherein the microprocessor is further programmed to calculate a feedback correction amount by using a proportional amount and an integral amount, and the integral amount used in the high load state is smaller than the integral amount used in the state other than the high load state.

6. The air-fuel ratio controller as defined in claim 1, wherein the microprocessor is further programmed to calculate a feedback correction amount by using a proportional amount and an integral amount, and the proportional amount used in the high load state is smaller than the proportional amount used in the state other than the high load state.

7. The air-fuel ratio controller as defined in claim 1, wherein the microprocessor is further programmed to calculate a feedback correction amount by using a proportional amount and an integral amount, and the integral amount used in the high load state is smaller than the integral amount used in the state other than the high load state.

8. The air-fuel ratio controller as defined in claim 2, wherein the microprocessor is further programmed to calculate a feedback correction amount by using a proportional amount and an integral amount, and the proportional amount used for the high speed region in the high load state is equal to the proportional amount used in a state other than the high load state.

9. The air-fuel ratio controller as defined in claim 2, wherein the microprocessor is further programmed to calculate a feedback correction amount by using a proportional amount and an integral amount, and the integral amount used for the high speed region in the high load state is equal to the integral amount used in a state other than the high load state.

10. An air-fuel ratio controller for controlling an air-fuel ratio of an air-fuel mixture supplied to an engine, comprising:

a fuel injection valve to inject fuel into the engine;

an oxygen sensor that outputs an oxygen concentration in the exhaust of the engine; and a microprocessor programmed to:

calculate a basic fuel injection amount based on a running condition of the engine;

calculate a feedback correction amount based on the oxygen concentration by using a proportional amount and an integral amounts so that the air-fuel ratio is controlled to be a predetermined air-fuel ratio;

store a learning value for a high load state being calculated based on the feedback correction amount in the high load state;

correct the basic fuel injection amount with the learning value when the engine is in the high load state so as to calculate a fuel injection amount, wherein the injection amount is injected from the fuel injection valve;

determine whether or not the high load state has continued for a predetermined time; and set the proportional amount to be smaller than the proportional amount used in the predetermined lime after the predetermined time has elapsed.

11. The air-fuel ratio controller as defined in claim 10, wherein the microprocessor is further programmed to store a second learning value calculated based on the feedback correction amount when the engine is in a state other than the high load state, and correct the basic fuel injection amount with the second learning value when the engine is in the state other than the high load state so as to calculate a fuel injection amount.

12. The air-fuel ratio controller as defined in claim 10, wherein the proportional amount in the predetermined time is smaller than the proportional amount used in a state other than the high load state.

13. The air-fuel ratio controller as defined in claim 10, wherein the microprocessor is further programmed to set the integral amount to be smaller than the integral amount used in the predetermined time after the predetermined time has elapsed.

14. An air-fuel ratio controller for controlling an air-fuel ratio of an air-fuel mixture supplied to an engine, comprising:

a fuel injection valve to inject fuel into the engine;

an oxygen sensor to detect an oxygen concentration in an exhaust of the engine; and a microprocessor programmed to:

calculate a basic injection amount based on a running condition of the engine;

calculate a feedback correction amount based on the oxygen concentration by using a proportional amount and an integral amount so that the air-fuel ratio is controlled to be a predetermined air-fuel ratio, wherein the proportional amount used in a high load state is smaller than the proportional amount used in a state other than the high load state;

store a learning value for the high load state, the learning value being calculated based on the feedback correction amount when the high load state is developed;

clamp the feedback correction amount in the high load state after the learning value is stored;

calculate a fuel injection amount by correcting the basic injection amount with the learning amount for the high load state when the engine is in the high load state, wherein the fuel injection amount is injected from the fuel injection valve.

15. The air-fuel ratio controller as defined in claim 14, wherein the microprocessor is further programmed to store a second learning value calculated based on the feedback correction amount when the engine is in the state other than the high load state, and correct the basic injection amount with the second learning value when the engine is in the state other than the high load state.

16. The air-fuel ratio controller as defined in claim 14, wherein the integral amount used in the high load state is smaller than the integral amount used in the state other than the high load state.

17. An air-fuel ratio controller for controlling an air-fuel ratio of an air-fuel mixture supplied to an engine, comprising:

a fuel injection valve to inject fuel into the engine;

an oxygen sensor to detect an oxygen concentration in an exhaust of the engine; and a microprocessor programmed to:

calculate a basic injection amount based on a running condition of the engine;

calculate a feedback correction amount based on the oxygen concentration so that the air-fuel ratio is controlled to be a predetermined air-fuel ratio;

store a learning value for the high load state, the learning value being calculated based on the feedback correction amount when the high load state is developed;

clamp the feedback correction amount in the high load state after the learning value is stored;

release the clamp of the feedback correction amount in the high load state when an engine rotation speed has risen to a predetermined high speed region after the learning value is stored; and calculate a fuel injection amount by correcting the basic injection amount with the learning amount for the high load state and the feedback correction amount when the engine is in the high load state, wherein the fuel injection amount is injected from the fuel injection valve.

18. The air-fuel ratio controller as defined in claim 17, wherein the microprocessor is further programmed to calculate the feedback correction amount using a proportional amount and an integral amount, and set the proportional amount used for the high speed region in the high load state to be equal to the proportional amount used in other than the high load state.

19. The air-fuel ratio controller as defined in claim 17, wherein the microprocessor is further programmed to calculate the feedback correction amount using a proportional amount and an integral amount, and set the integral amount used for the high speed region in the high load state to be equal to the integral amount used in other than the high load state.

* * * * *